US011130248B2

(12) United States Patent
Tucker et al.

(10) Patent No.: US 11,130,248 B2
(45) **Date of Patent: *Sep. 28, 2021**

(54) MULTI-MATERIAL PIVOT RETURN FOR SHAVING SYSTEMS

(71) Applicant: SHAVELOGIC, INC., Dallas, TX (US)

(72) Inventors: William E. Tucker, Plymouth, MA (US); Craig A. Provost, Newport Beach, CA (US); John W. Griffin, Moultonboro, NH (US); Aaron G. Cantrell, Northampton, MA (US); Douglas R. Kohring, Saco, ME (US)

(73) Assignee: SHAVELOGIC, INC., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/661,195

(22) Filed: Oct. 23, 2019

(65) Prior Publication Data

US 2020/0164537 A1 May 28, 2020

Related U.S. Application Data

(60) Continuation of application No. 15/270,273, filed on Sep. 20, 2016, now Pat. No. 10,500,747, which is a (Continued)

(51) Int. Cl.

| | |
|---|---|
| ***B26B 21/52*** | (2006.01) |
| ***B26B 21/40*** | (2006.01) |
| ***B26B 21/22*** | (2006.01) |

(52) U.S. Cl.

CPC ..... *B26B 21/521* (2013.01); *B26B 21/225* (2013.01); *B26B 21/4068* (2013.01); *B26B 21/4081* (2013.01); *Y10T 83/04* (2015.04)

(58) Field of Classification Search

CPC . B20B 21/521; B26B 21/4081; B26B 21/446; B26B 21/225; B26B 21/14;

(Continued)

(56) References Cited

U.S. PATENT DOCUMENTS

| | | |
|---|---|---|
| D996,879 | 7/1911 | Odell |
| 1,015,575 A | 1/1912 | Meyer |

(Continued)

FOREIGN PATENT DOCUMENTS

| | | |
|---|---|---|
| EP | 0951971 A1 | 10/1999 |
| EP | 1245351 | 10/2002 |

(Continued)

OTHER PUBLICATIONS

International Search Report/Written Opinion—PCT Application No. PCT/US2015/20538, dated Jun. 24, 2015, 8 pages.

(Continued)

*Primary Examiner* — Ghassem Alie

(74) *Attorney, Agent, or Firm* — Leber IP Law; Celia H. Leber

(57) ABSTRACT

Replaceable shaving assemblies are disclosed that include a blade unit, an interface element configured to removeably connect the blade unit to a handle, on which the blade unit is pivotably mounted, and a return element disposed between the blade unit and interface element. The return element provides resistance during shaving and positions the blade unit in a rest position when not in use.

20 Claims, 27 Drawing Sheets

Related U.S. Application Data division of application No. 14/101,194, filed on Dec. 9, 2013, now abandoned.

(58) Field of Classification Search

CPC ..... B26B 21/165; B26B 21/16; B26L 2031/7186; B29C 66/534; B29C 65/08; B29C 66/54

USPC ..... 83/13; 30/521, 531, 41, 41.5, 529, 530, 30/535, 534, 527, 50, 57, 532, 533

See application file for complete search history.

(56) References Cited

U.S. PATENT DOCUMENTS 1,074,615 A 10/1913 Folmer
1,498,155 A 6/1924 Dorr
1,822,766 A 9/1931 Duffy
2,406,983 A 9/1946 Anderson
2,406,985 A 9/1946 Anderson
3,311,975 A 4/1967 De Longuyon
3,593,416 A 7/1971 Edson
3,709,517 A 1/1973 Wossner
3,768,348 A 10/1973 Braun et al.
3,938,247 A 2/1976 Carbonell et al.
4,094,063 A 6/1978 Trotta
4,198,746 A 4/1980 Trotta
4,347,663 A 9/1982 Ullmo
4,403,414 A 9/1983 Kiraly et al.
4,475,286 A 10/1984 Saito
4,774,765 A 10/1988 Ferraro
4,785,534 A 11/1988 Lazarchik
4,834,760 A 5/1989 Richter, Jr.
4,838,564 A 6/1989 Jarvis
4,850,518 A 7/1989 Salmon et al.
4,970,784 A 11/1990 Althaus et al.
5,029,391 A 7/1991 Althaus et al.
5,074,042 A 12/1991 Althaus et al.
5,138,361 A 8/1992 Iwamoto et al.
5,145,201 A 9/1992 Metheny
5,168,628 A 12/1992 Mock et al.
5,219,468 A 6/1993 Olson
5,369,885 A 12/1994 Ferraro
5,402,574 A 4/1995 Milner
5,466,901 A 11/1995 Mochizuki
5,533,263 A 7/1996 Gilder
5,551,153 A 9/1996 Simms
5,551,717 A 9/1996 De Courcey Milne
5,560,106 A 10/1996 Armbruster
5,645,603 A 7/1997 Peters
5,661,907 A 9/1997 Apprille, Jr.
5,669,139 A 9/1997 Oldroyd
5,678,316 A 10/1997 Althaus
5,771,591 A 6/1998 Armbruster
5,794,342 A 8/1998 Davey
5,813,293 A 9/1998 Apprille, Jr.
5,855,071 A 1/1999 Apprille et al.
5,890,296 A 4/1999 Metcalf et al.
6,014,918 A 1/2000 Orloff
6,112,412 A 9/2000 Richard
6,122,826 A 9/2000 Coffin
6,138,361 A 10/2000 Follo
6,145,201 A 11/2000 Andrews
6,161,287 A 12/2000 Swanson et al.
6,182,366 B1 2/2001 Richard
6,216,345 B1 4/2001 Andrews
6,223,442 B1 5/2001 Pina
6,311,400 B1 11/2001 Hawes
6,357,118 B1 3/2002 Eichhorn et al.
6,502,318 B1 1/2003 Gilder
6,557,265 B2 5/2003 Coffin
6,560,881 B2 5/2003 Coffin
6,612,040 B2 9/2003 Gilder
6,615,498 B1 9/2003 King et al.
6,772,523 B1 8/2004 Richard
6,807,739 B2 10/2004 Follo
6,854,188 B1 2/2005 Wonderley
6,880,253 B1 4/2005 Gyllerstrom
6,973,730 B2 12/2005 Tomassetti
6,990,740 B2 1/2006 Follo et al.
7,028,405 B2 4/2006 Paas et al.
7,086,160 B2 8/2006 Coffin
7,100,284 B2 9/2006 King
7,103,976 B2 9/2006 Pennella
7,152,512 B1 12/2006 Prochaska
7,200,942 B2 4/2007 Richard
7,441,336 B2 10/2008 Hawes et al.
7,461,458 B2 12/2008 Peyser
7,526,869 B2 5/2009 Blatter et al.
7,574,809 B2 8/2009 Follo
7,669,511 B2 3/2010 King
7,797,834 B2 9/2010 Steunernberg
7,802,368 B2 9/2010 Coffin et al.
7,877,879 B2 2/2011 Nakasuka
7,971,363 B2 7/2011 Nakasuka
8,033,023 B2 10/2011 Johnson
8,096,054 B2 1/2012 Denkert et al.
8,166,661 B2 5/2012 King
8,205,343 B2 6/2012 Winter et al.
8,205,344 B2 6/2012 Stevens
8,273,205 B2 9/2012 Murgida
8,307,552 B1 11/2012 Drouillard
8,484,852 B2 7/2013 King
8,499,459 B2 8/2013 Efthimaidis et al.
8,590,162 B2 11/2013 Park et al.
8,640,342 B2 2/2014 Murgida
8,671,577 B2 3/2014 Brown
8,732,955 B2 5/2014 Howell et al.
8,769,825 B2 7/2014 Howell et al.
8,789,282 B2 7/2014 Wilson et al.
8,793,880 B2 8/2014 Taub et al.
8,844,145 B2 9/2014 Psimadas et al.
9,283,685 B2 3/2016 Griffin et al.
9,475,202 B2 10/2016 Griffin et al.
9,486,930 B2 11/2016 Provost et al.
9,623,575 B2 4/2017 Griffin et al.
9,630,331 B2 4/2017 Griffin et al.
9,701,034 B2 7/2017 Papadopoulos-Papageorgis et al.
9,902,077 B2 2/2018 Park et al.
2002/0059729 A1 5/2002 Ikuta et al.
2002/0138992 A1 10/2002 Richard
2002/0157255 A1 10/2002 Coffin
2003/0046819 A1 3/2003 Ferraro
2003/0154603 A1 8/2003 Guimont et al.
2003/0200659 A1 10/2003 Coffin et al.
2003/0200660 A1 10/2003 Pennella et al.
2003/0205858 A1 11/2003 Hall
2003/0213130 A1* 11/2003 Motta ..... B26B 21/225 30/50
2004/0010918 A1 1/2004 Orloff et al.
2004/0177519 A1 9/2004 Tomassetti et al.
2005/0039338 A1 2/2005 King
2005/0207837 A1 9/2005 Kosh et al.
2005/0278954 A1 12/2005 Orloff et al.
2006/0037197 A1 2/2006 Hawes et al.
2006/0080837 A1 4/2006 Johnson et al.
2006/0080838 A1 4/2006 Johnson
2006/0283025 A1 12/2006 Follo et al.
2007/0151106 A1 7/2007 Steunenberg et al.
2007/0204932 A1 9/2007 Freed
2007/0289139 A1 12/2007 Peyser et al.
2008/0155831 A1 7/2008 Royle
2008/0189964 A1 8/2008 Bozikis
2008/0196251 A1 8/2008 Royle
2009/0000126 A1 1/2009 Kraus
2009/0038167 A1 2/2009 Peyser
2009/0235539 A1 9/2009 Wonderley
2010/0011583 A1 1/2010 Efthimiadis et al.
2010/0043242 A1 2/2010 Stevens
2010/0083505 A1 4/2010 Royle et al.
2011/0016724 A1 1/2011 Murgida
2011/0088269 A1 4/2011 Walker, Jr. et al.
2011/0138586 A1 6/2011 Gompert et al.
2011/0192031 A1 8/2011 Coresh
2011/0247217 A1 10/2011 Johnson et al.

(56) References Cited

U.S. PATENT DOCUMENTS

| | | | |
|---|---|---|---|
| 2012/0060382 | A1 | 3/2012 | Beugels et al. |
| 2012/0073554 | A1 | 3/2012 | Victor et al. |
| 2012/0124840 | A1 | 5/2012 | Iaccarino et al. |
| 2012/0210586 | A1 | 8/2012 | Lelieveld et al. |
| 2012/0297625 | A1 | 11/2012 | Madden |
| 2013/0025578 | A1 | 1/2013 | Jones |
| 2013/0081289 | A1 | 4/2013 | Wain et al. |
| 2013/0174821 | A1 | 7/2013 | Jones |
| 2014/0083265 | A1 | 3/2014 | Provost et al. |
| 2014/0109735 | A1 | 4/2014 | Shepperson |
| 2015/0158192 | A1 | 6/2015 | Tucker |
| 2015/0174776 | A1 | 6/2015 | Hawes |
| 2015/0190935 | A1 | 7/2015 | Griffin |
| 2015/0190936 | A1 | 7/2015 | Griffin |
| 2015/0290819 | A1 | 10/2015 | Giannopoulos |
| 2015/0306777 | A1 | 10/2015 | Georgakis |
| 2015/0314465 | A1 | 11/2015 | Giannopoulos |
| 2015/0314466 | A1 | 11/2015 | Papadopoulos-Papgeorgis |
| 2017/0036360 | A1 | 2/2017 | Griffin et al. |
| 2017/0182672 | A1 | 6/2017 | Griffin et al. |

FOREIGN PATENT DOCUMENTS

| | | |
|---|---|---|
| EP | 1488894 | 12/2004 |
| EP | 2123410 | 11/2009 |
| GB | 1460732 | 1/1977 |
| GB | 2030909 | 4/1980 |
| WO | 2006127435 | 11/2006 |
| WO | 2010022192 | 2/2010 |
| WO | 2012158143 | 11/2012 |
| WO | 2014051843 | 4/2014 |
| WO | 2014094909 | 6/2014 |

OTHER PUBLICATIONS

Search Report—Corresponding European Patent Application No. 13840539, dated Apr. 25, 2016, 7 pages.

Search Report—Corresponding European Patent Application No. 13864593, dated Jul. 8, 2016, 7 pages.

European Patent Application No. 19192461.2 Extended European Search Report dated Dec. 4, 2019, 8 pages.

* cited by examiner

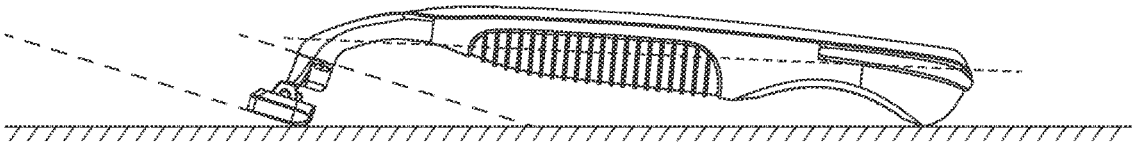
FIG. 14A
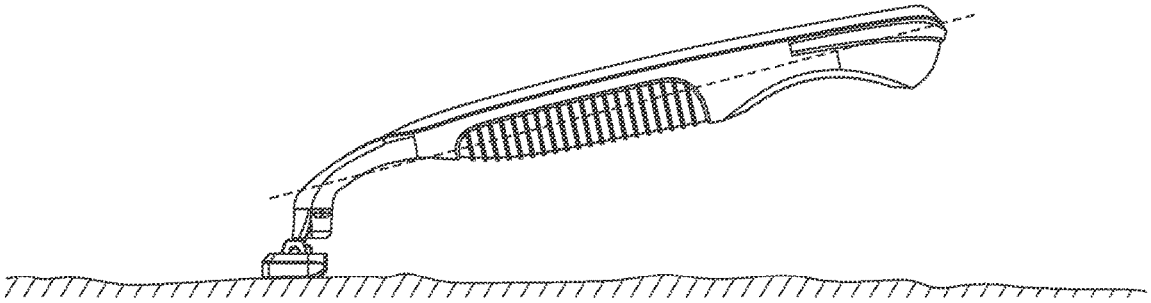
FIG. 14B
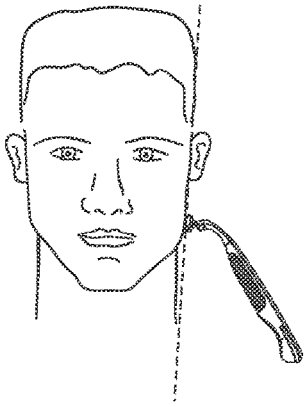
FIG. 14C
Range of Handle Rotation on Skin Surface
FIG. 14D
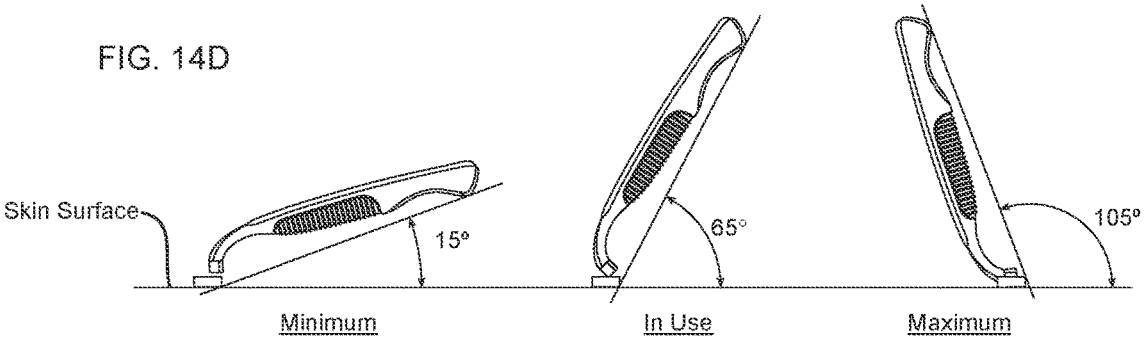

MULTI-MATERIAL PIVOT RETURN FOR SHAVING SYSTEMS

RELATED APPLICATION

This application is a continuation of U.S. patent application Ser. No. 15/270,273, filed Sep. 20, 2016, which is a divisional application of U.S. patent application Ser. No. 14/101,194, filed Dec. 9, 2013, now abandoned. The entire content of these applications are incorporated herein by reference.

BACKGROUND

The invention relates to shaving systems having handles and replaceable blade units. Shaving systems often consist of a handle and a replaceable blade unit in which one or more blades are mounted in a plastic housing. Such shaving systems often include a pivoting attachment between the blade unit and handle, which allows the blade unit to maintain optimum contact with the surface being shaved. The pivoting attachment often includes a mechanism to provide resistance during shaving and return the blade unit to a neutral or "rest" position when it is not in contact with the user's skin.

SUMMARY

Generally, the present disclosure pertains to shaving systems and to replaceable shaving assemblies for use in such systems. The systems include a flexible return element. The flexible return element is a multi-material element that includes a semi-rigid plastic layer and an elastomeric material, which work together to provide the resistance and return forces that are often provided by a pusher and follower mechanism in prior art shaving systems.

In one aspect, the invention features a replaceable shaving assembly comprising a blade unit and an interface element configured to removeably connect the blade unit to a handle, on which the blade unit is pivotably mounted. The interface element further comprising a multi-material return element configured to provide a return force between the blade unit and handle.

Some implementations may include one or more of the following features.

The return element can be configured to bias the blade unit towards a rest position with respect to a pivot axis that is generally parallel to a long axis of the blade unit. The return element may comprise a non-elastomeric thermoplastic material. Furthermore, the return element may comprise an elastomeric element, e.g., a layer of thermoplastic elastomer or thermoplastic urethane. The return element may be generally U-shaped, or may be in the form of one or more fingers. If the return element is U-shaped, a base portion of the U-shape may be configured to engage a surface of the blade unit. The return element may be configured to bend or buckle upon rotation of the blade unit toward an upper surface of the handle.

In some implementations, the interface element comprises a substantially rigid portion defining a cavity configured to receive a distal end of the handle. The return element may be molded onto or attached to interface element, e.g., to the substantially rigid portion of the interface element. The interface element may comprise pivot elements that are configured to be received by corresponding elements on the blade unit.

In another aspect, the invention features a shaving system comprising: a handle having a distal end and a proximal end; and a shaving assembly, mounted on the distal end of the handle. The shaving assembly includes an interface element configured to connect the blade unit to the handle, and a blade unit that is pivotably mounted on the interface element, the interface element comprising a multi-material return element configured to provide a return force between the blade unit and handle.

In some implementations, this aspect of the invention can include any one or more of the features discussed above or elsewhere herein.

Moreover, in some implementations the interface element may be configured to be removably mounted on the handle, allowing replacement of the shaving assembly. Alternatively, the interface element may be fixedly mounted on the handle, e.g., attached to the handle by mechanical engagement or welding, or by molding the interface element integrally with the handle.

In yet a further aspect, the invention features a method of shaving comprising contacting the skin with the blade unit of a shaving system. The shaving system comprises (a) a handle having a distal end and a proximal end, and (b) pivotably mounted on the distal end of the handle, a replaceable shaving assembly that includes a blade unit and an interface element configured to removeably connect the blade unit to the handle, the interface element comprising a multi-material return element configured to provide a return force between the blade unit and handle.

In some implementations, the method may include any of the features disclosed above or elsewhere herein.

DESCRIPTION OF THE DRAWINGS

FIGS. 14A-14D are diagrammatic views illustrating how the angle of the blade unit with respect to the handle at rest, and to the skin surface during shaving, is measured.

DETAILED DESCRIPTION

Figure 1:
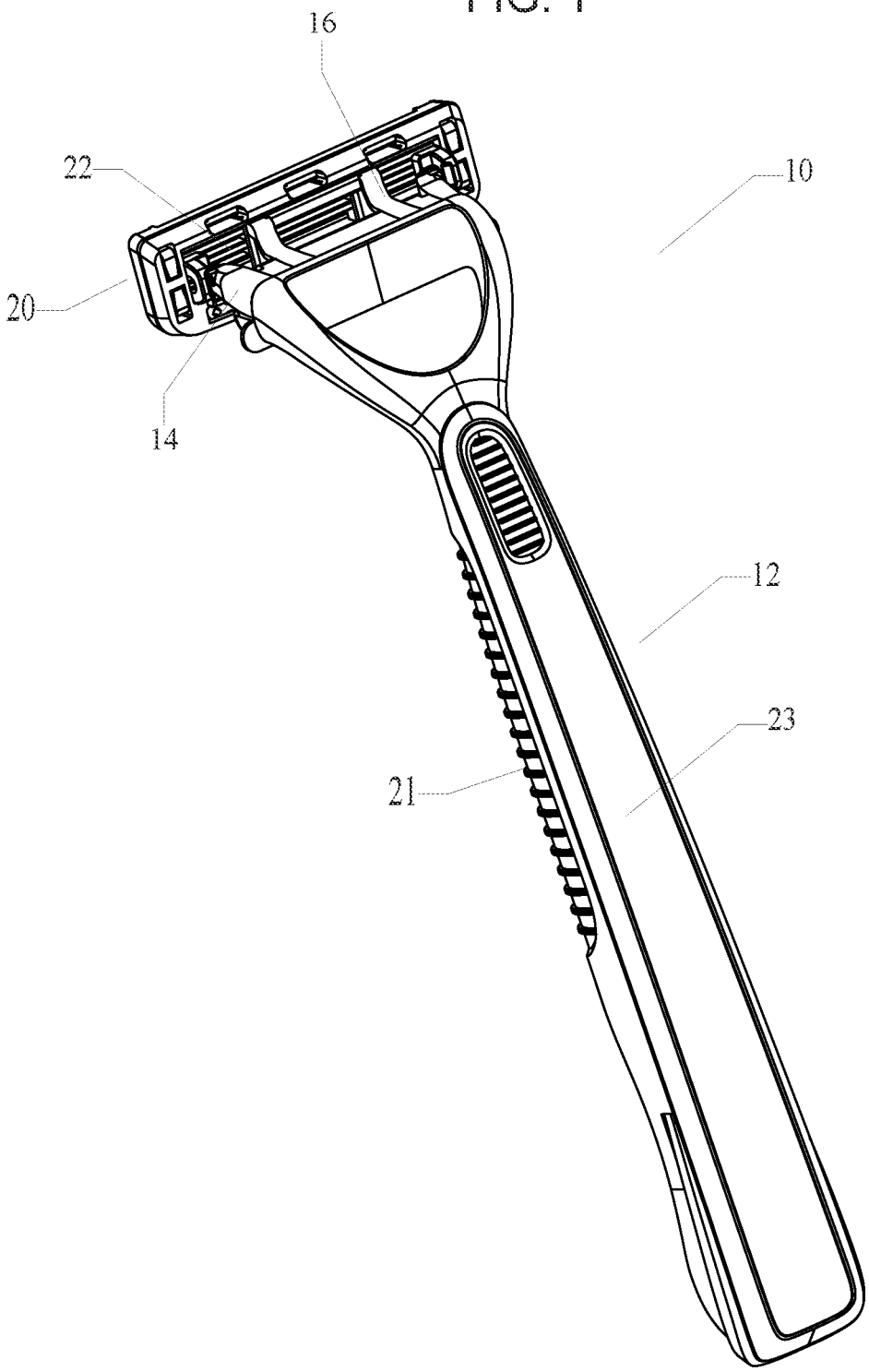
FIG. 1 is a perspective view of a shaving system according to one implementation, with the blade unit in one rotational position.
Figure 2:
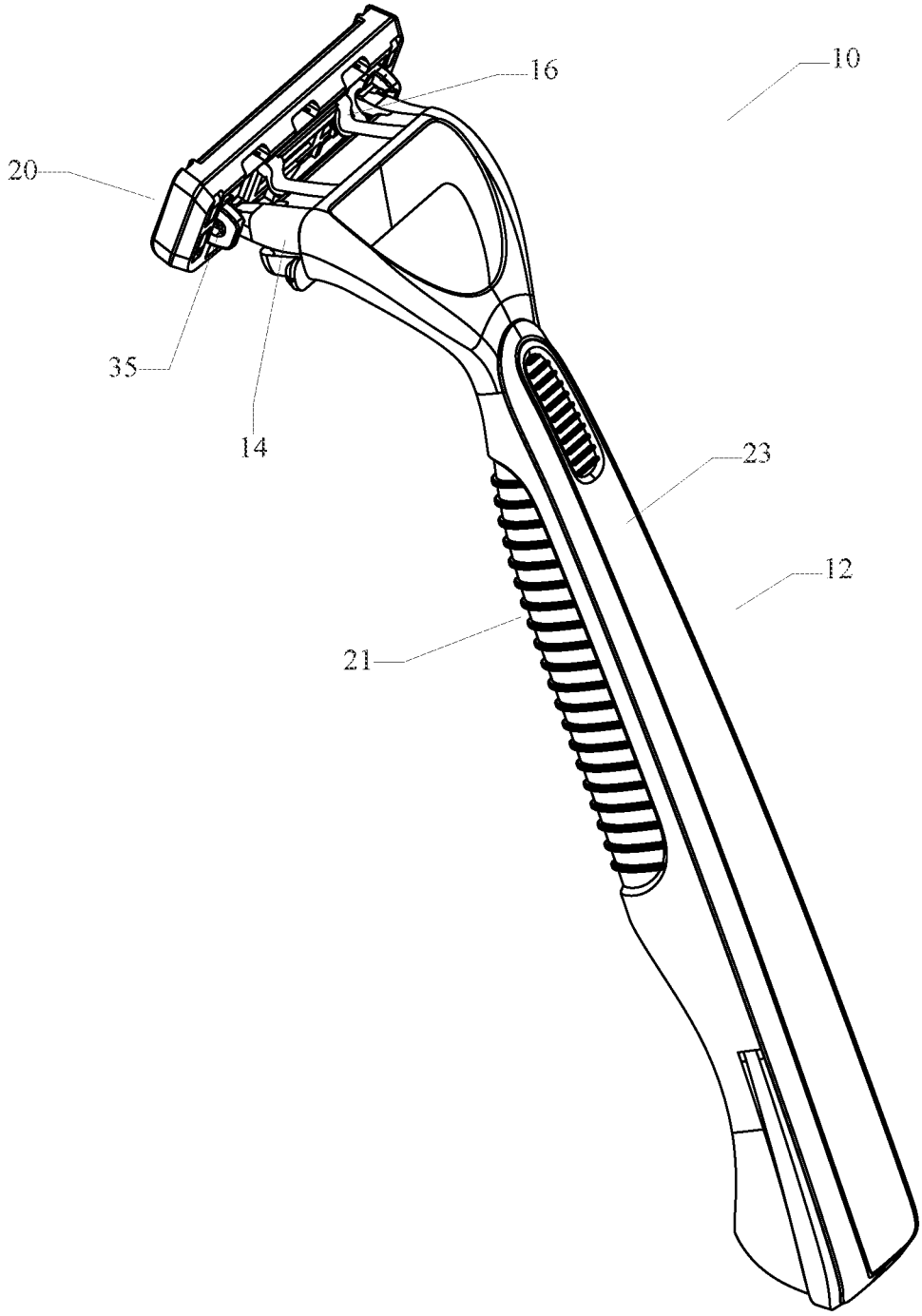
FIG. 2 is a perspective view of a shaving system according to one implementation, with the blade unit in a second rotational position.
Figure 3:
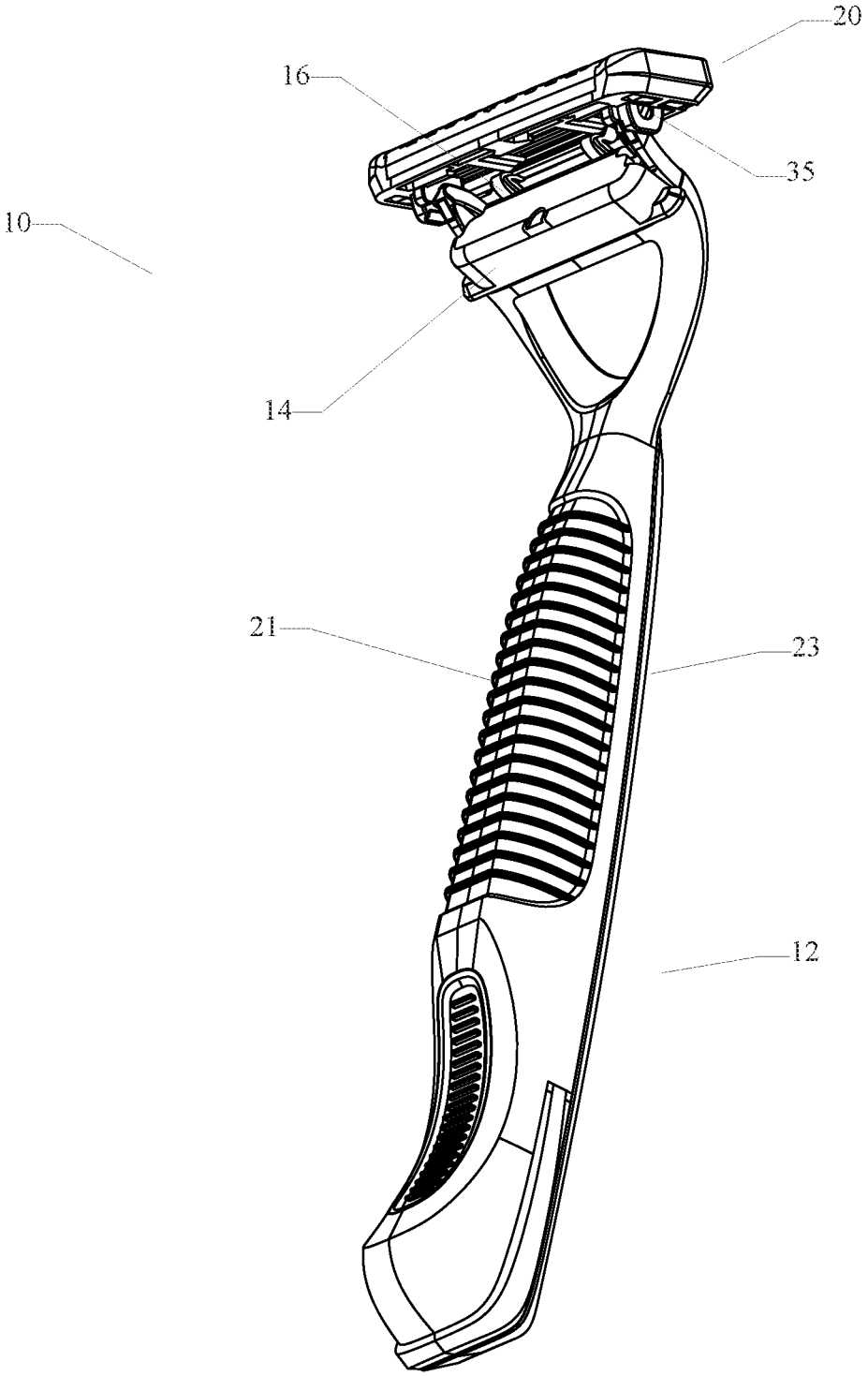
FIG. 3 is a perspective view of a shaving system according to one implementation, with the blade unit in a third rotational position.
Figure 8:
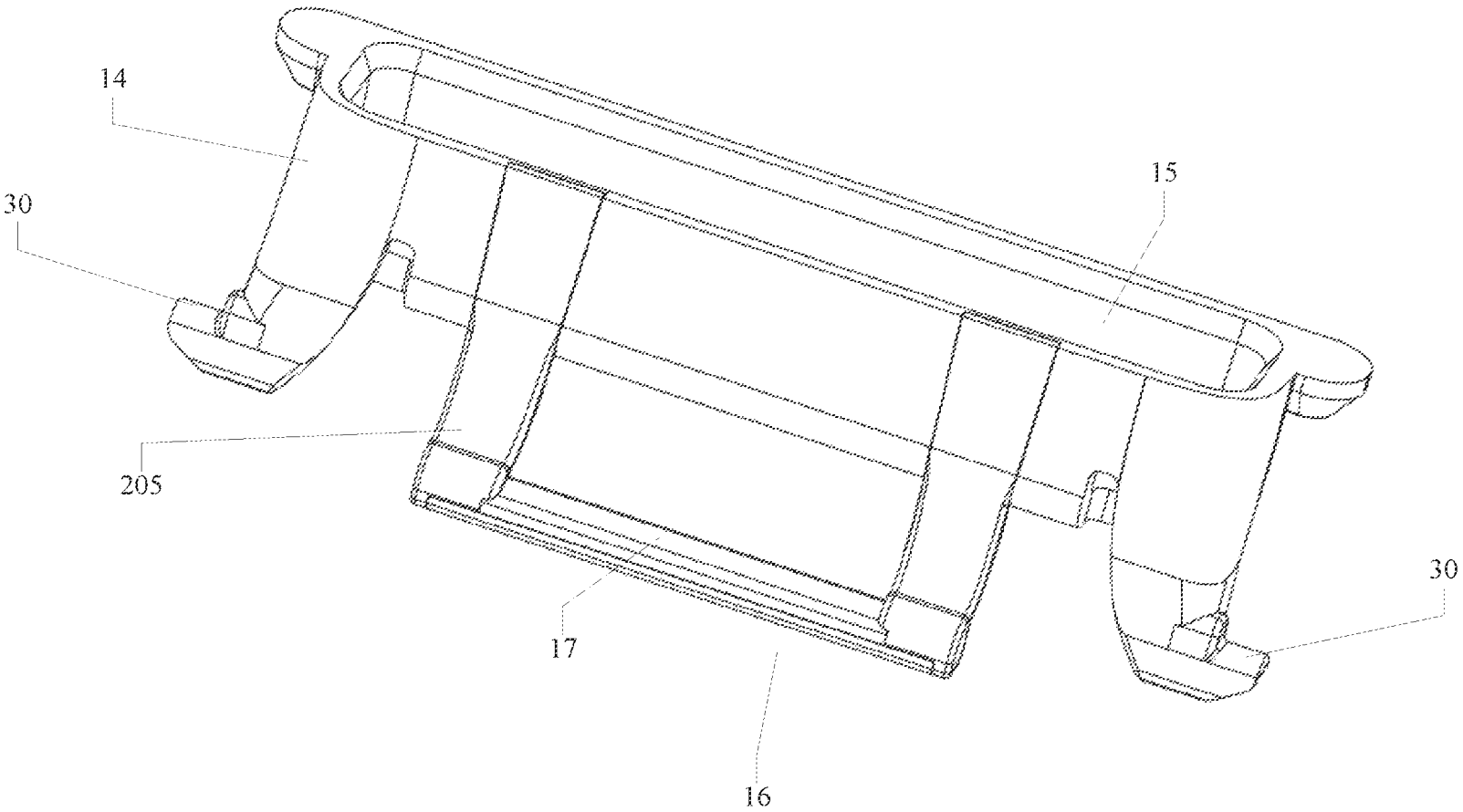
FIG. 8 is a perspective view of one embodiment of the return element.
Figure 9:
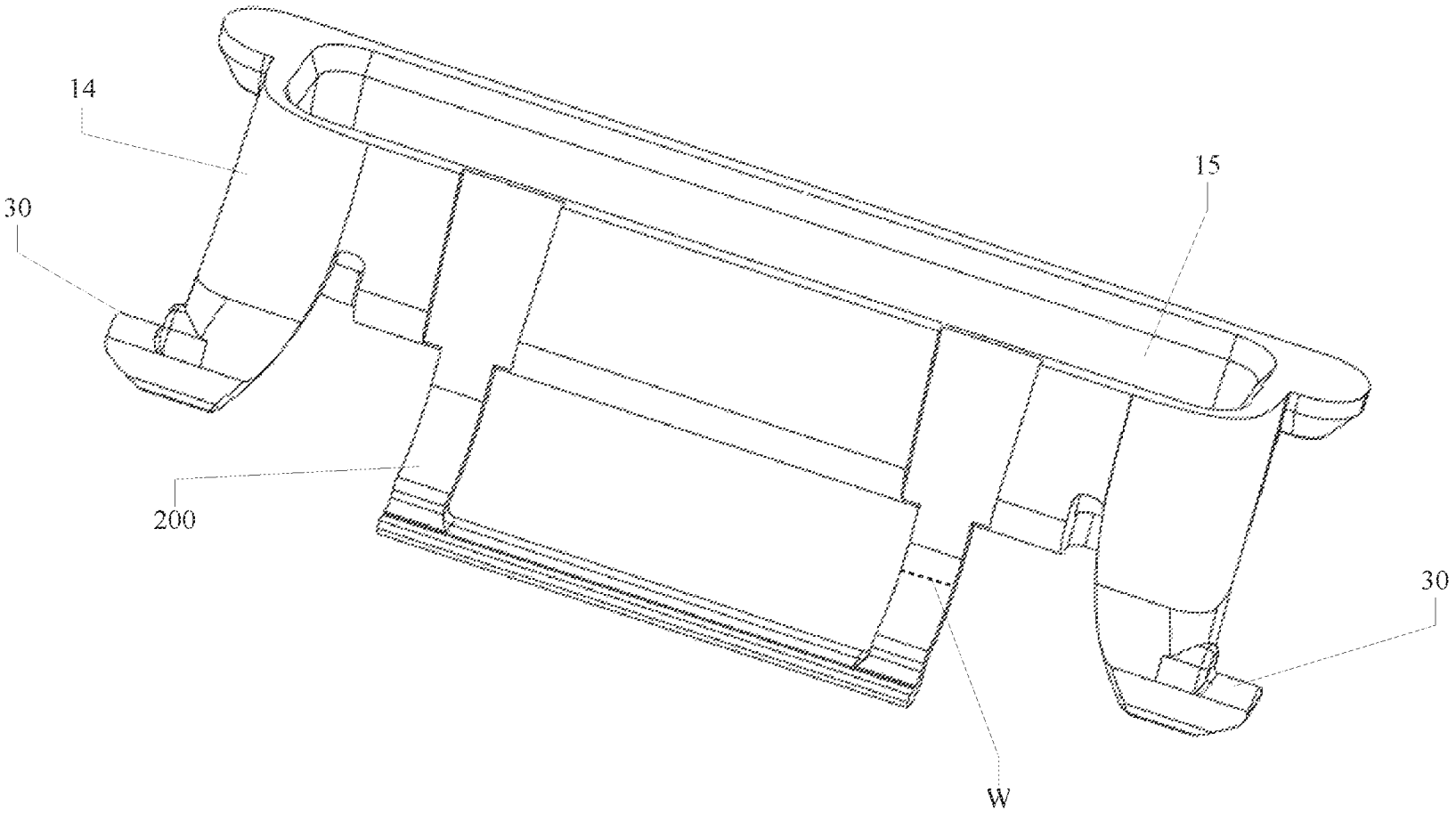
FIG. 9 is a perspective view of an embodiment of the return element with the elastomeric element removed.

FIGS. 1-3 show a shaving system 10 that includes a handle 12, an interface element 14, a return element 16, and a blade unit 20 that includes a plurality of blades 22 (FIG. 1) and that is pivotably mounted on the interface element. The interface element includes a generally rigid body that defines a cavity 15 (FIG. 8) dimensioned to receive the distal end of handle 12. Generally, the interface element 14, the return element 16, and blade unit 20 are sold to the consumer as an integrated replaceable shaving assembly.

Figure 4:
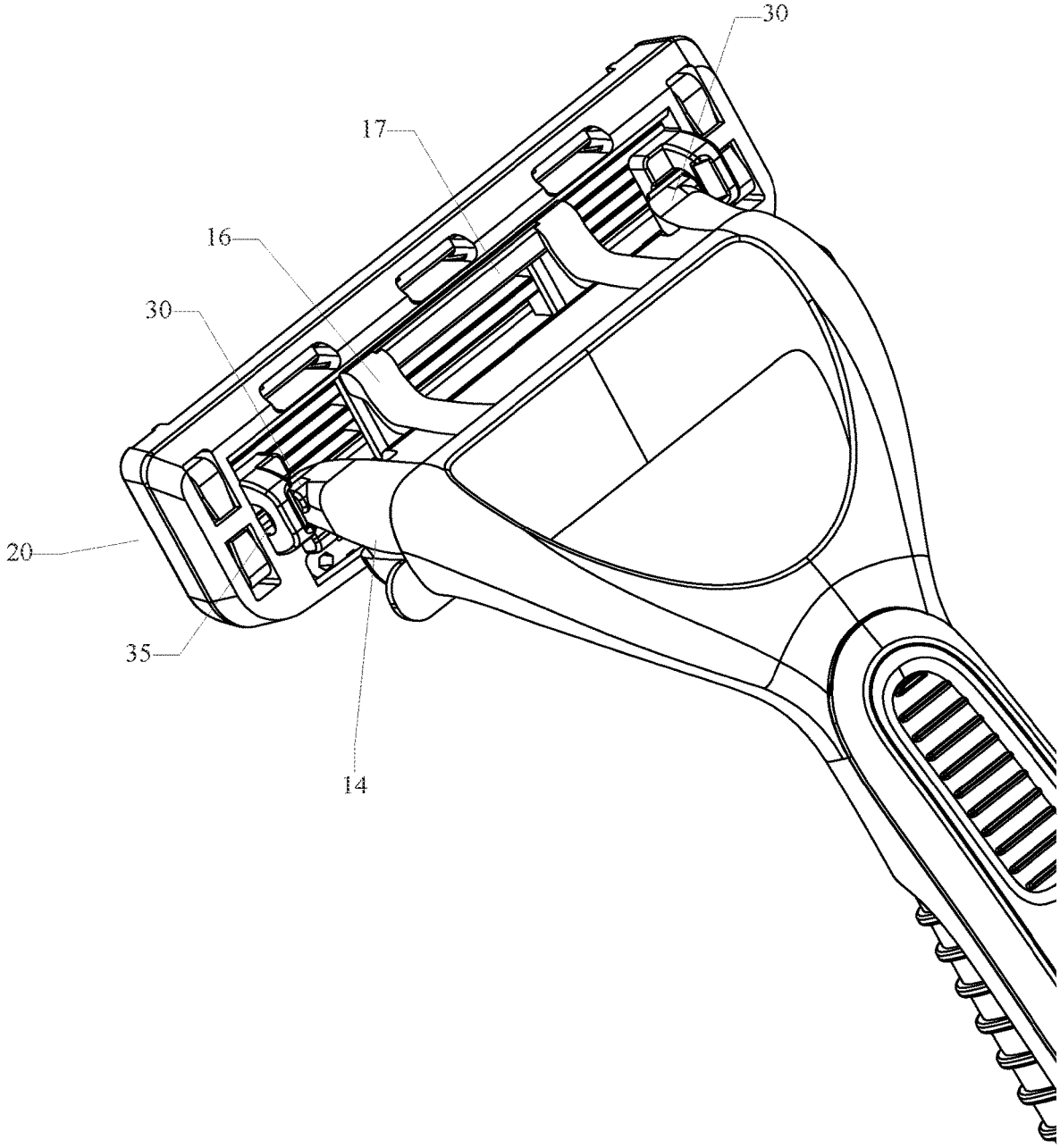
FIG. 4 is an enlarged perspective view of the shaving assembly and a portion of the handle of the shaving system shown in FIG. 1.
Figure 5:
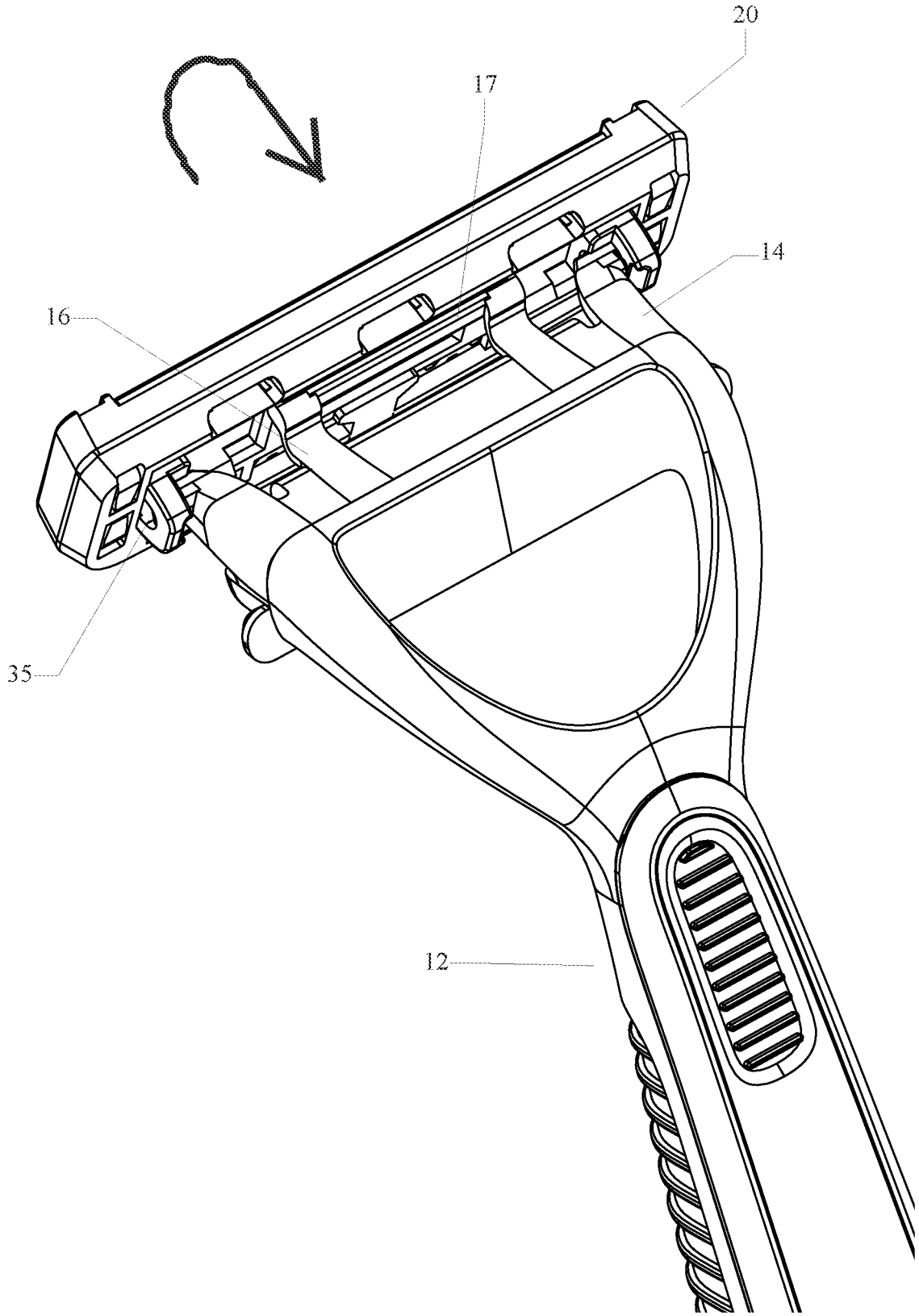
FIG. 5 is an enlarged perspective view similar to that of FIG. 4, showing the blade unit being rotated toward the upper part of the handle, as indicated by the arrow.
Figure 5A:
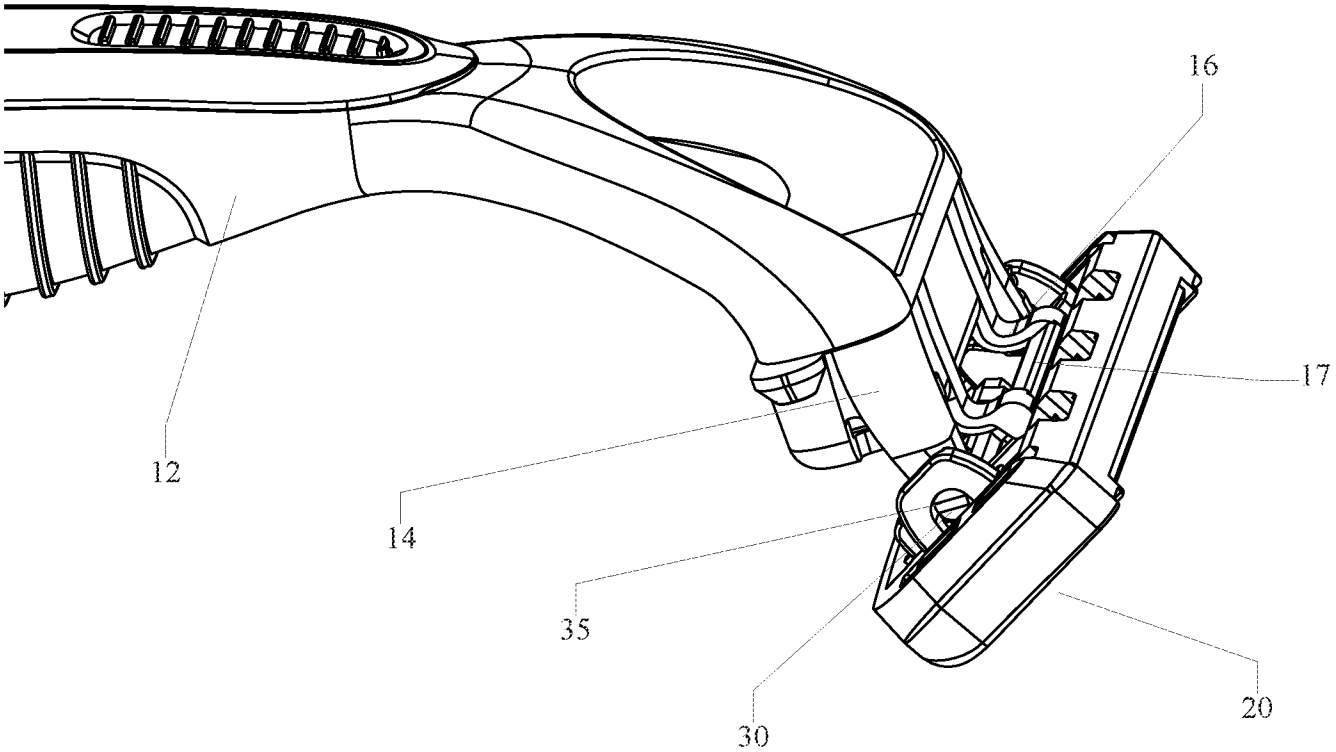
FIGS. 5A and 5B show the same rotational position of the blade unit from a different viewpoint.
Figure 5B:
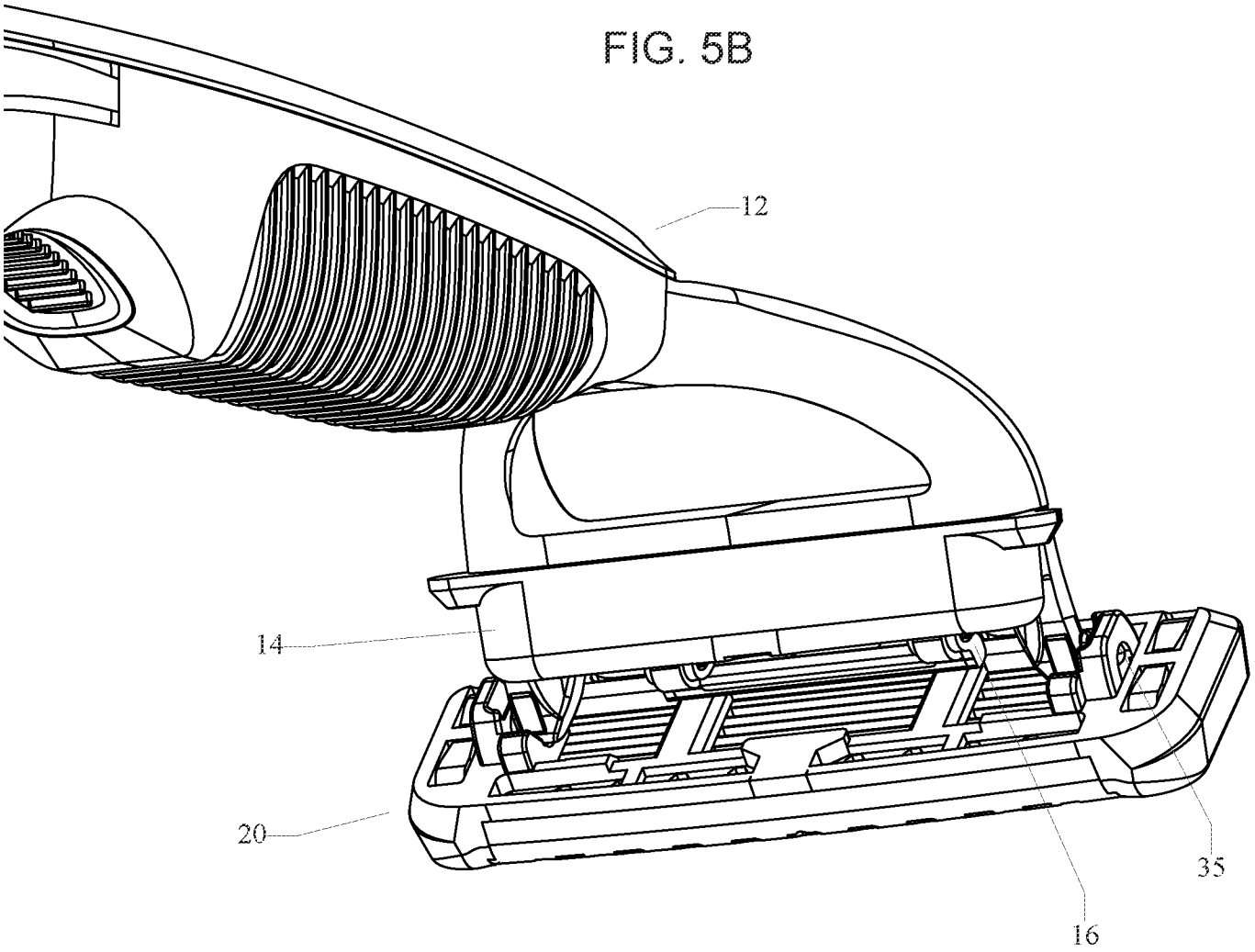
Figure 18:
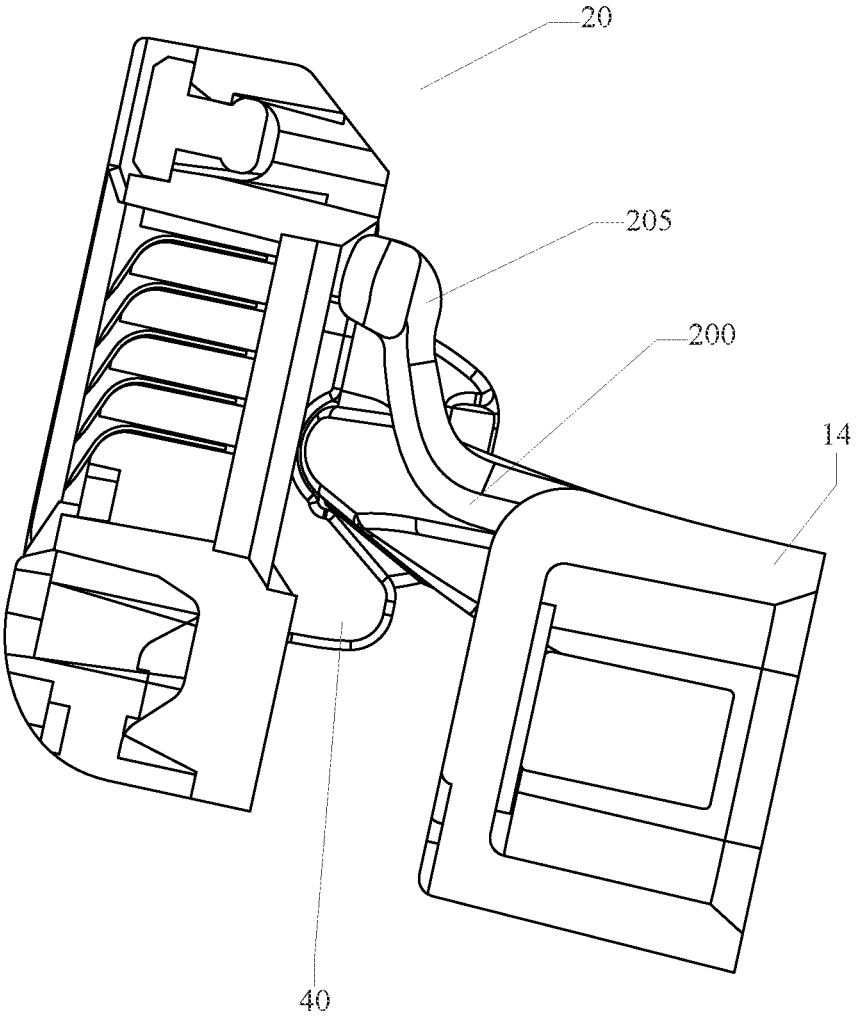
FIG. 18 is a diagrammatic side plan view showing an example of a pivot stop that may be used in the shaving systems disclosed herein.

Referring to FIG. 4, the blade unit 20 is mounted on interface element 14 by the positioning of a pair of fingers 30 (FIG. 7A) which extend from the interface element 14 into receiving bores 35 (FIGS. 5, 5A, 5B) on the blade unit 20. The receiving bores 35 may be molded integrally with the blade unit 20. This attachment allows pivoting of the blade unit with respect to the interface unit and thus the handle. A blade unit pivot stop (e.g., a stop flange 40 as shown in FIG. 18) may be integrally formed with the blade unit 20 to limit the pivoting of the blade unit 20. Pivoting of the blade unit 20 is about an axis that is generally parallel to the long axis of the blade unit and is generally positioned to allow the blade unit 20 to follow the contours of a user's skin during shaving. Referring to FIGS. 14A-14D, preferably the angle of blade unit 20 with respect to handle 12 is about 15 degrees at rest, and the angle of the blade unit with respect to the skin surface can range from approximately 15° to 105° during shaving. The handle 12 provides a manner in which the shaving system can be manipulated and leverage can be applied to achieve desired shaving results.

The blade unit 20 is shown in three different rotational orientations in FIGS. 1-3. In FIG. 1, the blade unit is preloaded by the return element and is in an at rest position, pivoted slightly toward a bottom surface 21 of the handle; in FIG. 2, the blade unit is pivoted slightly toward a top surface 23 of the handle, and in FIG. 3 the blade unit is pivoted further toward the top surface 23. These positions are representative of the normal range of pivoting motion of the blade unit. As the blade unit pivots between these positions, the return element 16 flexes between an extended position (FIG. 1) and a bent position (FIG. 3), as will be discussed further below.

Figure 7:
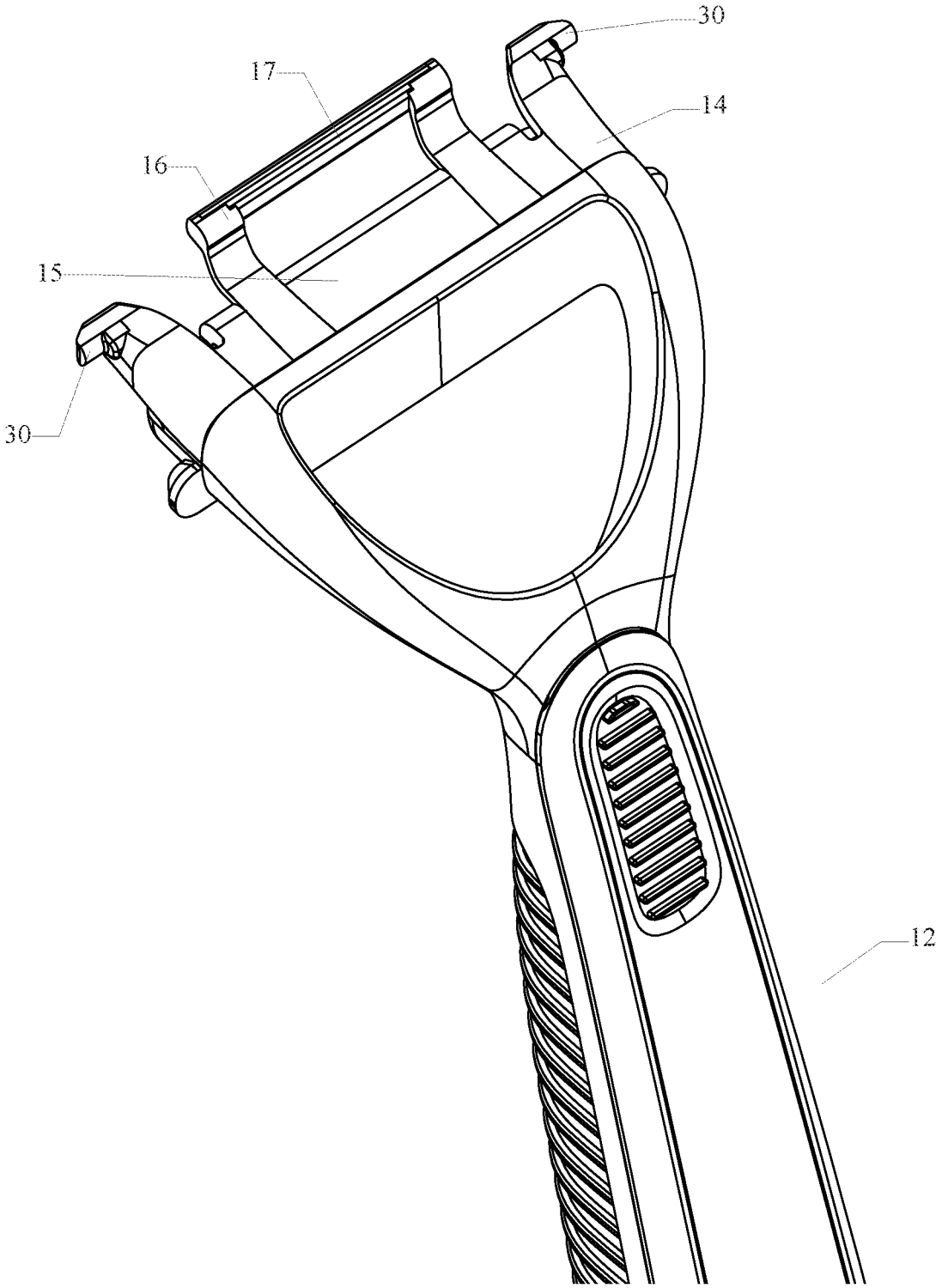
FIG. 7 is a perspective view of an embodiment of the handle, interface element and return element with the blade unit removed for clarity.
Figure 7A:
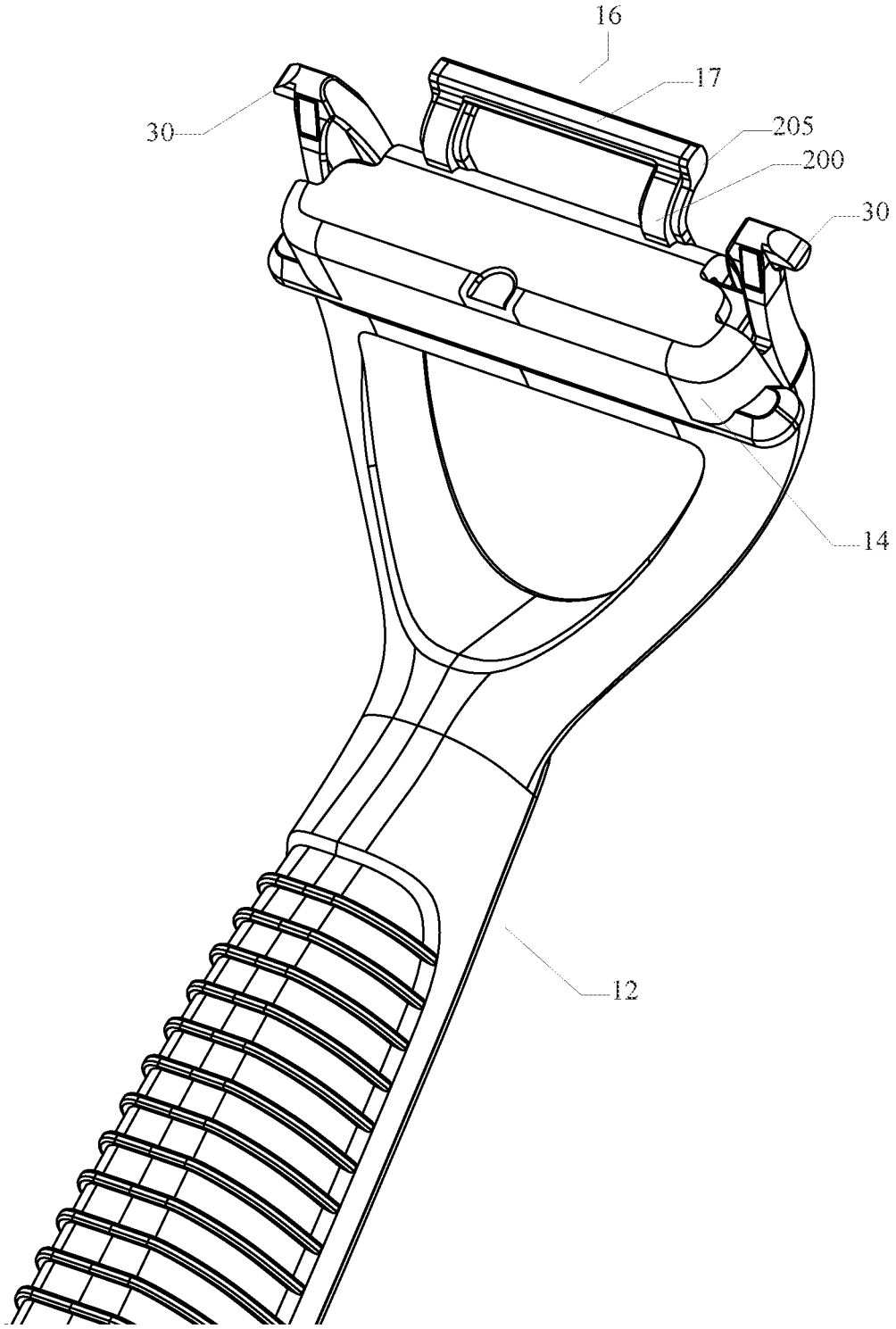
FIG. 7A is a perspective view of shows the embodiment shown in FIG. 7 from the bottom. the handle, interface element and return element with the blade unit removed for clarity.

Referring to FIGS. 7 and 7A, the return element 16 is mounted on interface element 14 and extends generally downwardly and outwardly from surface 15 of the interface element. The return element 16 is generally U-shaped, and includes a generally straight central portion 17 that is configured to engage the back surface of the blade unit (e.g., as shown in FIG. 4).

Figure 6:
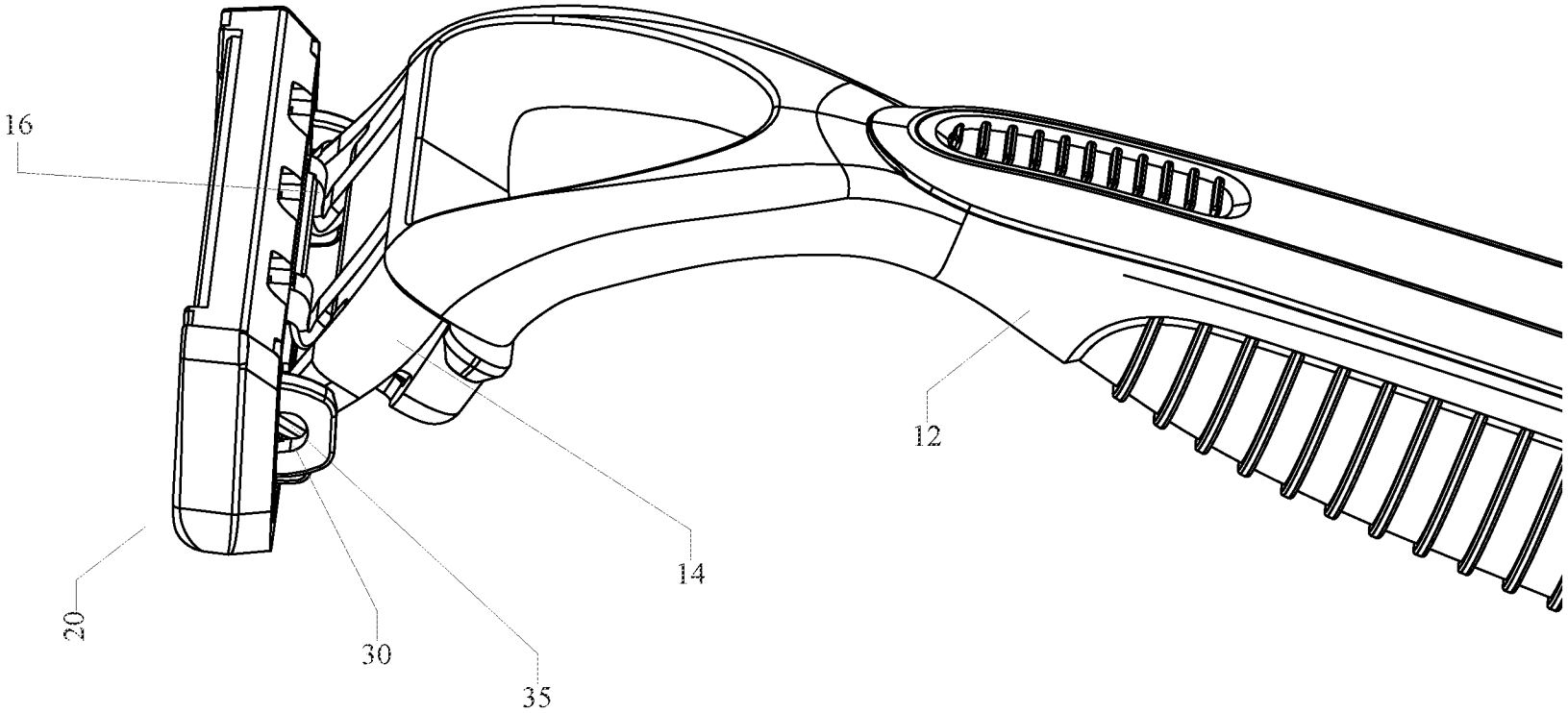
FIGS. 6 and 6A show the shaving assembly with the blade unit rotated further toward the upper part of the handle.
Figure 6A:
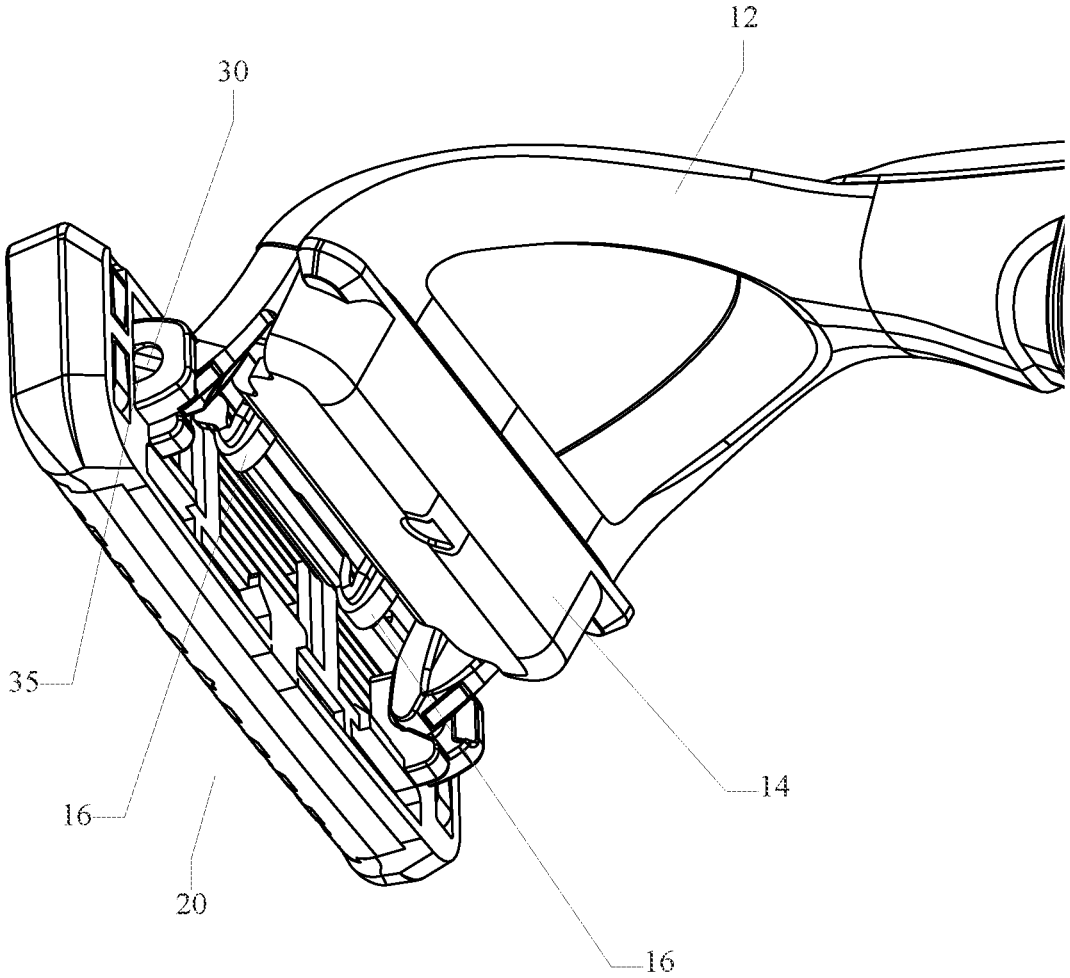

As shown in detail in FIGS. 4-6A, as the blade unit pivots toward the upper surface of the handle 23, the return element 16 deforms more and more, until it finally reaches the bent position shown in FIGS. 6 and 6A. As it deforms, the return element 16 provides resistance during shaving, limiting the free pivoting of the blade unit about the pivot axis described above. In addition, the return element 16 provides a return force that biases the blade unit 20 towards its rest position, in the same manner that resistance and return force are typically provided by a pusher/follower assembly.

In all of the embodiments discussed herein, the return element is designed such that its geometry and other characteristics provides an applied load as assembled that is sufficient to overcome the friction of the system at rest (pretensioned load), typically at least 5 grams, e.g., 5 to 40 grams, and a load during shaving of from about 30 to 110 grams.

Referring to FIGS. 7-13, the return element 16 comprises a multi-layer laminate that includes two generally distinct elements: a backbone element 200 of a non-elastomeric plastic material, and an elastomeric element 205 that covers the backbone element 200. The backbone element 200 extends from the lower surface 15 of the interface element 14, as shown in FIG. 7A. The backbone element is thin (e.g., from about 0.05 to 1.5 mm thick, for example from 0.3 to 1 mm), and is wide relative to its thickness, giving it good torsional rigidity. The backbone may not have a uniform thickness and/or width; the thickness range given above is the average thickness of the backbone. In some implementations, the ratio of width to thickness is between about 1:1 and 10:1, where width is measured as indicated by W in FIG. 9. As a result, the return element 16 resists flexure that would be about the long axis of the handle.

The backbone element may also help protect the return element from unwanted deformation during manufacturing, assembly, shipment, and storage. The backbone element provides lateral stability to the return element, due to its torsional rigidity, keeping the return element properly located during manufacturing and use. The multi-material return element also has a spring rate that combines the properties of the two materials (elastomeric and non-elastomeric) so as to provide both a relatively high preload and a relatively low spring rate during shaving.

The backbone element can be formed, for example, from a non-elastomeric thermoplastic material such as acetyls (e.g., POM), polyvinyl chloride (PVC), high impact polystyrene (PS), polypropylene (PP), polyethylene (PE) (high and low density), ABS. Preferred materials have sufficient rigidity to provide the desired degree of lateral stability to the return element.

The elastomeric element 205 comprises an elastomer that is molded to or over the backbone element. Generally, the backbone element 200 is much thinner than the elastomeric element. The elastomeric element 205 enhances the flexing characteristics of the return element 16. The elastomeric element 205 maybe, for example, from about 0.25 to 2.5 mm thick, for example from about 0.5 to about 1.5 mm.

The elastomeric element can be formed, for example, from synthetic or natural rubber materials. Other suitable materials could include, for example, polyether-based thermoplastic elastomers (TPEs) available from Kraiburg HTP, polyether-based thermoplastic vulcanizate elastomer (TPVs) available from GLS PolyOne Corporation under the tradename Santoprene™ and thermoplastic urethanes (TPUs) available from GLS PolyOne Corporation under the tradename VERSOLLAN™. The elastomeric material is selected to provide a desired degree of restoring force and durability. In some implementations the material has a durometer of 30 to 80 Shore A.

A number of embodiments have been described. Nevertheless, it will be understood that various modifications may be made without departing from the spirit and scope of the disclosure.

Figure 15:
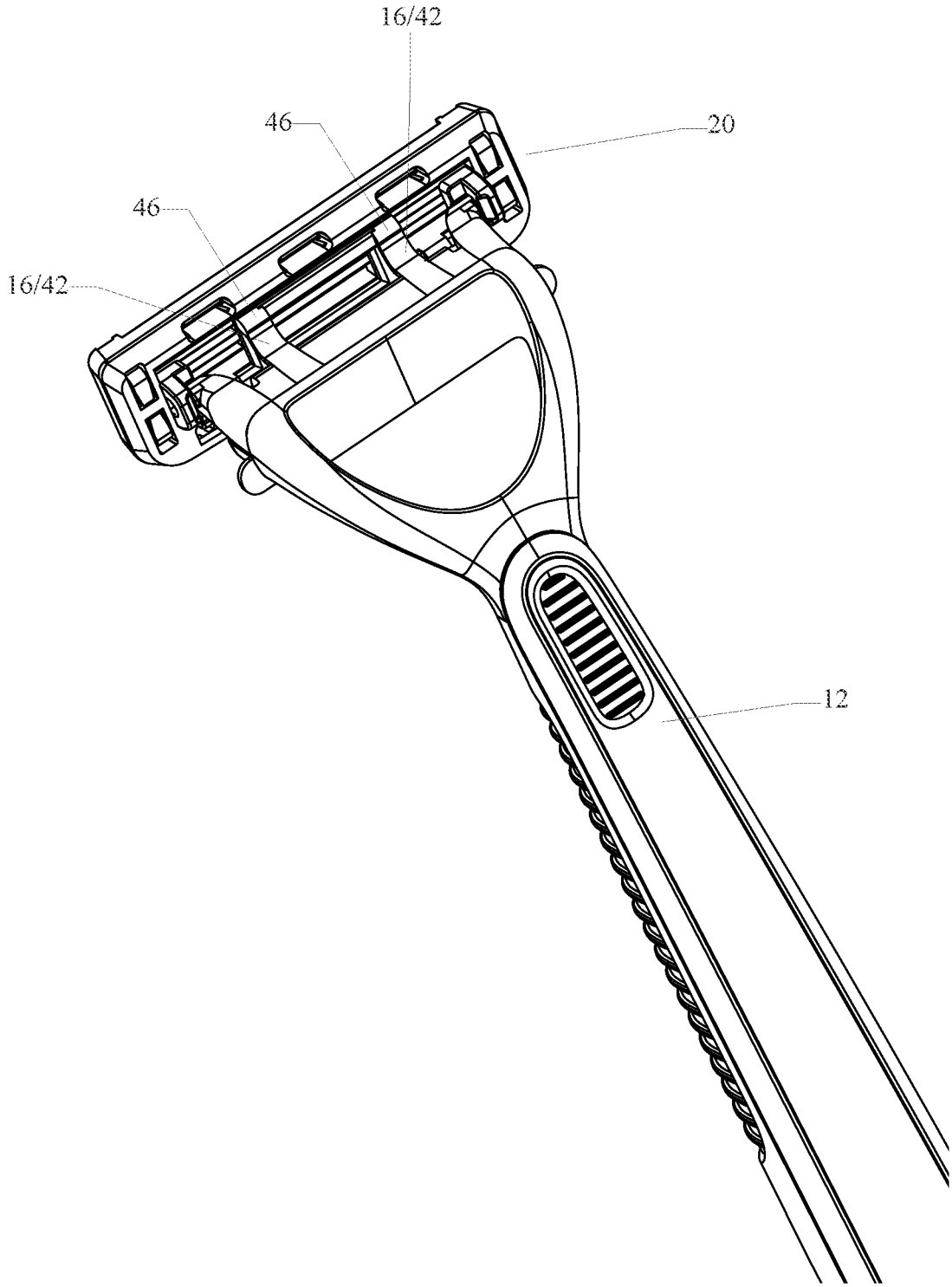
FIGS. 15 and 16 are perspective views of shaving systems according to alternate embodiments.
Figure 16:
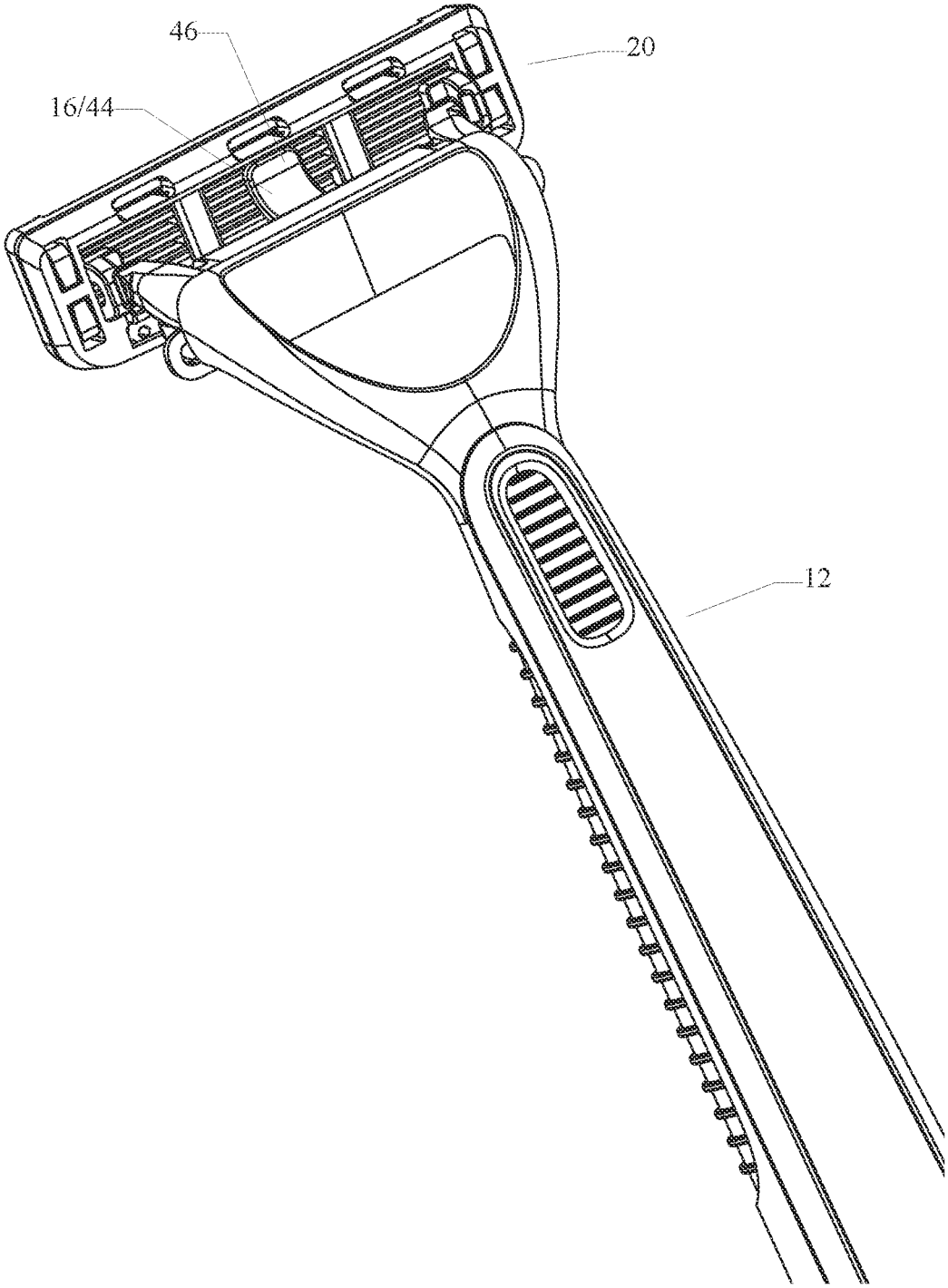
Figure 17A:
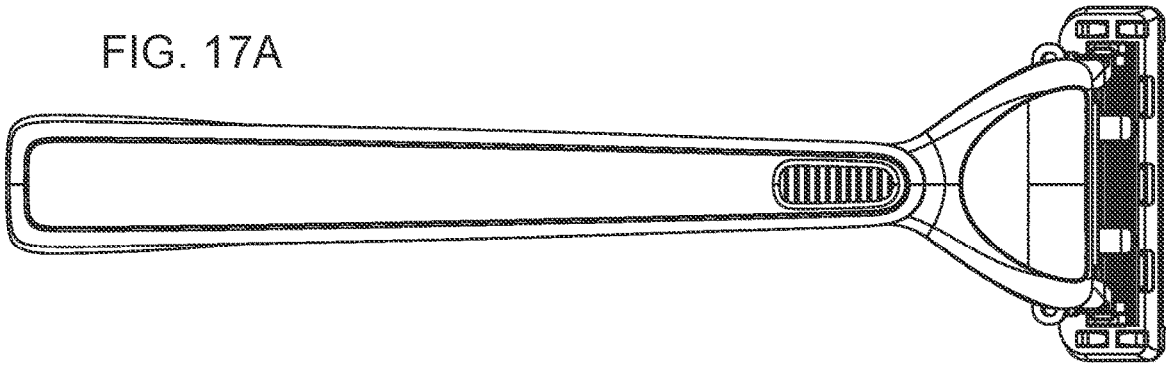
FIGS. 17A-17C are plan views of shaving systems according to three embodiments.
Figure 17B:
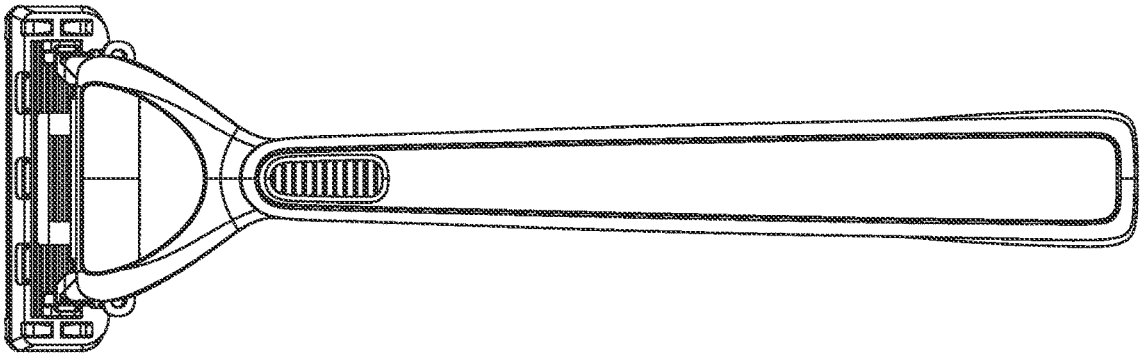
Figure 17C:
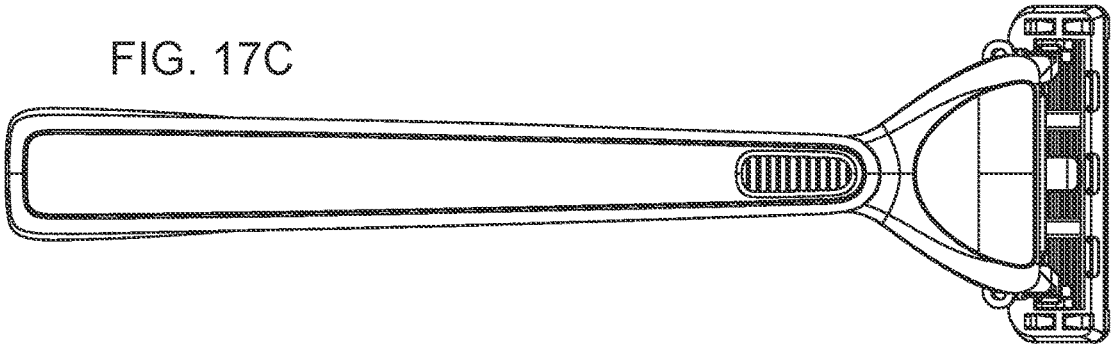

For example, the return element may have a different shape, for example the return element 16 may be in the form of two separate members 42, as shown in FIG. 15, or a single, centrally disposed member 44, as shown in FIG. 16. In this case, the members are configured to deform in the same manner described above and provide a similar restoring force. In these implementations, as well as in some implementations in which the return element is generally U-shaped, the back surface of blade unit 20 may include one or more support features 46 which are positioned to act as a stop for the distal end of the return element 16. Support features 46 may enhance the ability of the return element 16 to bend or buckle in response to rotational forces.

Figure 19A:
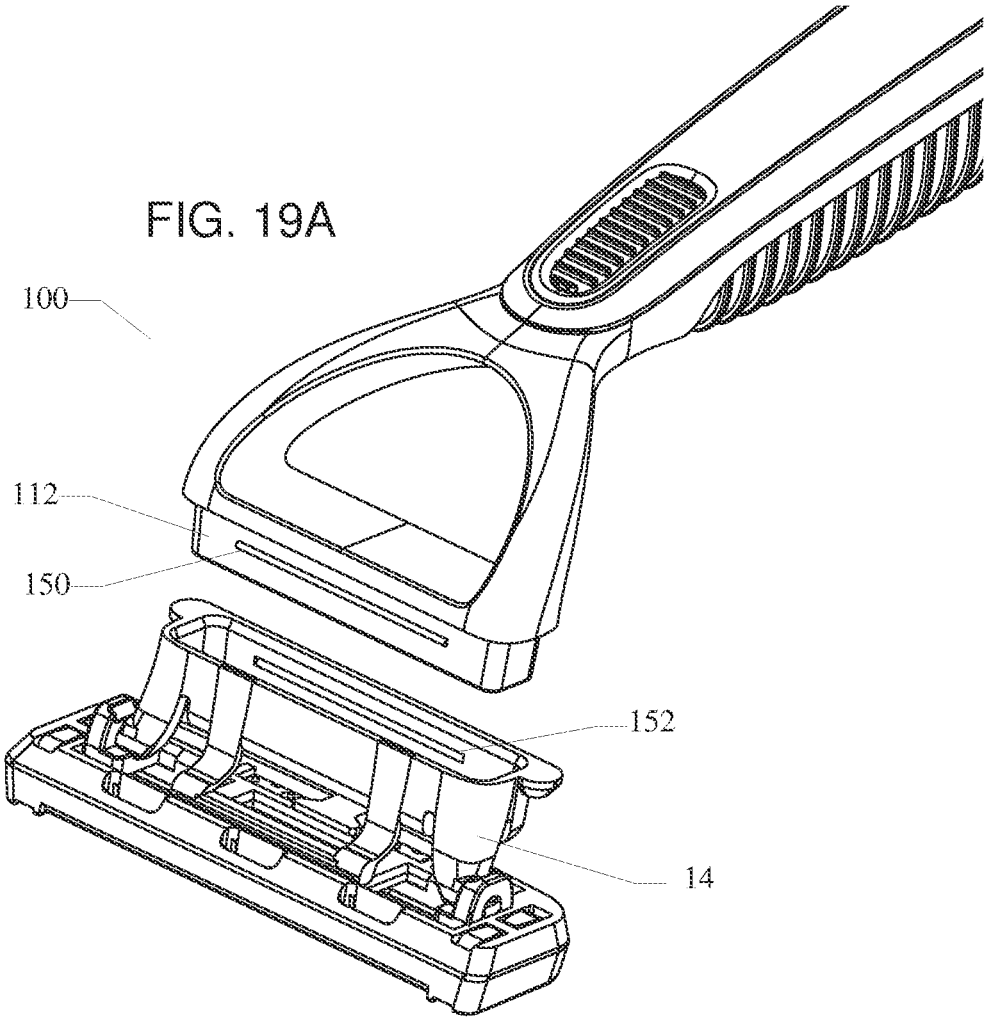
FIGS. 19A-19B are perspective views of an embodiment in which the shaving assembly is designed to be permanently attached to the handle.
Figure 19B:
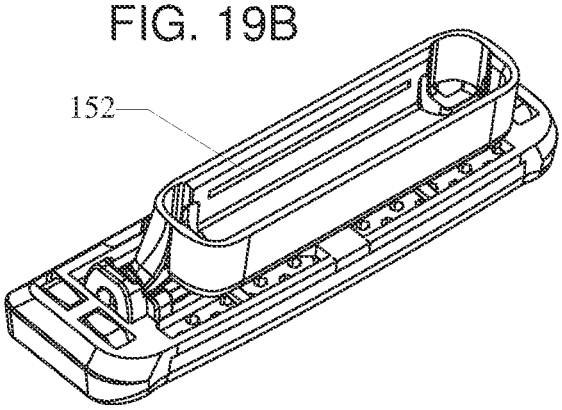

Also, while removable shaving assemblies have been discussed above, in some implementations the shaving system is designed to be disposable as a whole. In these cases, the shaving assembly is affixed to the handle in a manner that is not intended for the consumer to remove, e.g., by fixedly mounting the interface element on the distal end of the handle. This may be accomplished, for example, by engagement of corresponding mechanical locking features on the handle and interface element, by welding (e.g., ultrasonic welding), by molding the interface element integrally with the handle, or by any other desired mounting technique. An example of a disposable shaving system 100 is shown in FIG. 19A, and the shaving assembly for such a system is shown in FIG. 19B. In this case, the handle 112 includes protrusions 150 (only one of which is shown, the other being on the opposite side of the handle), and the interface element includes corresponding locking indentations 152.

Figure 10:
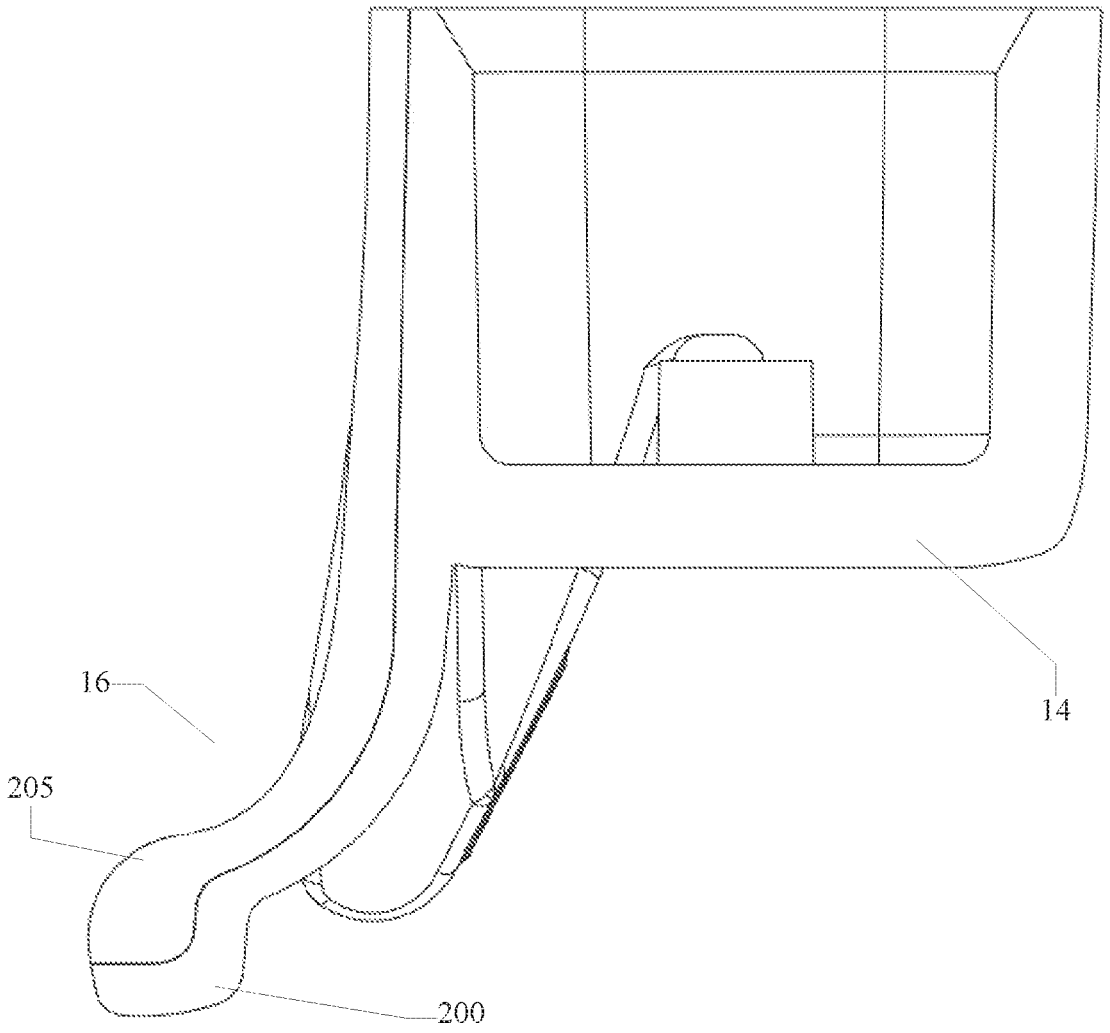
FIG. 10 is a side, sectional view of one embodiment.
Figure 11:
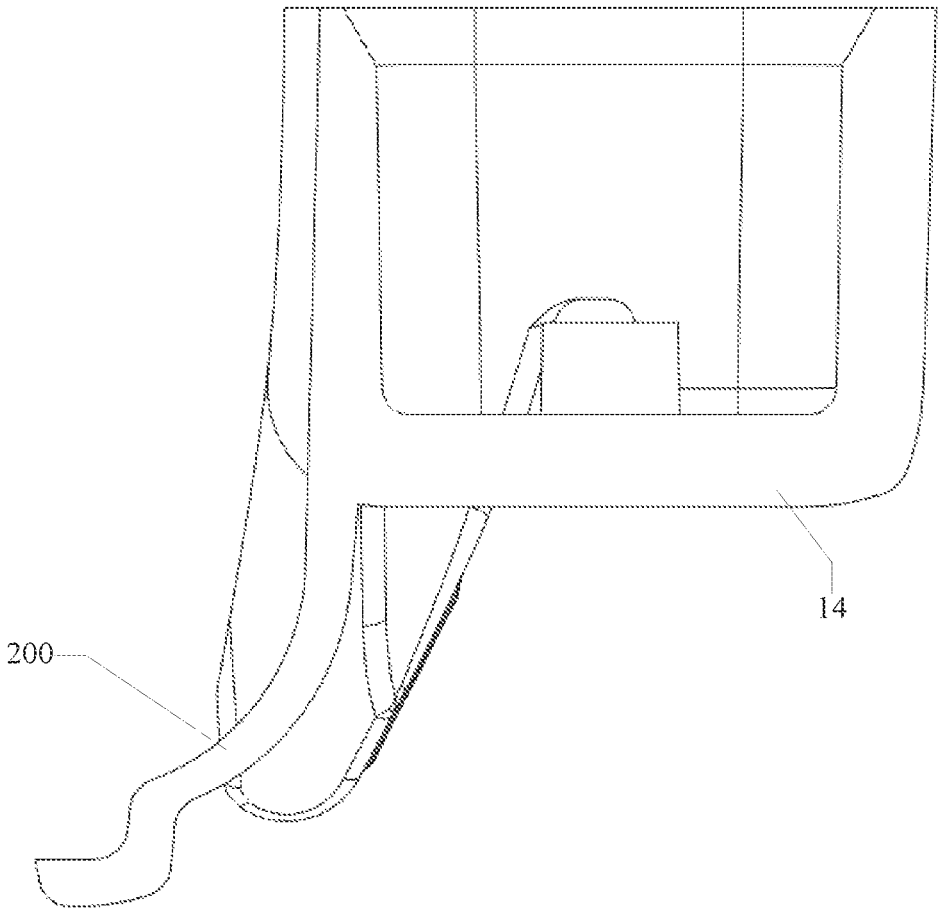
FIG. 11 is a side, sectional view of one embodiment with the elastomeric element removed.
Figure 12:
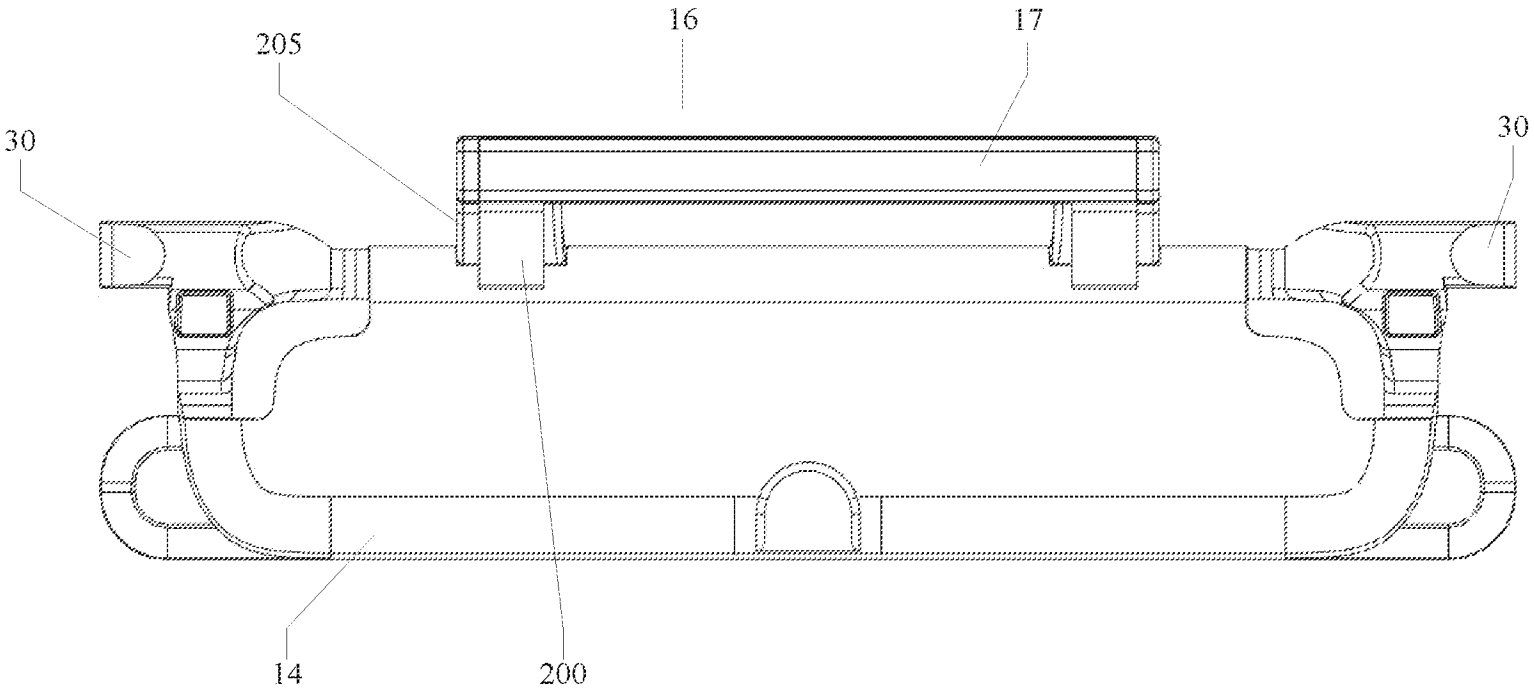
FIG. 12 is a bottom, planar view of one embodiment.
Figure 13:
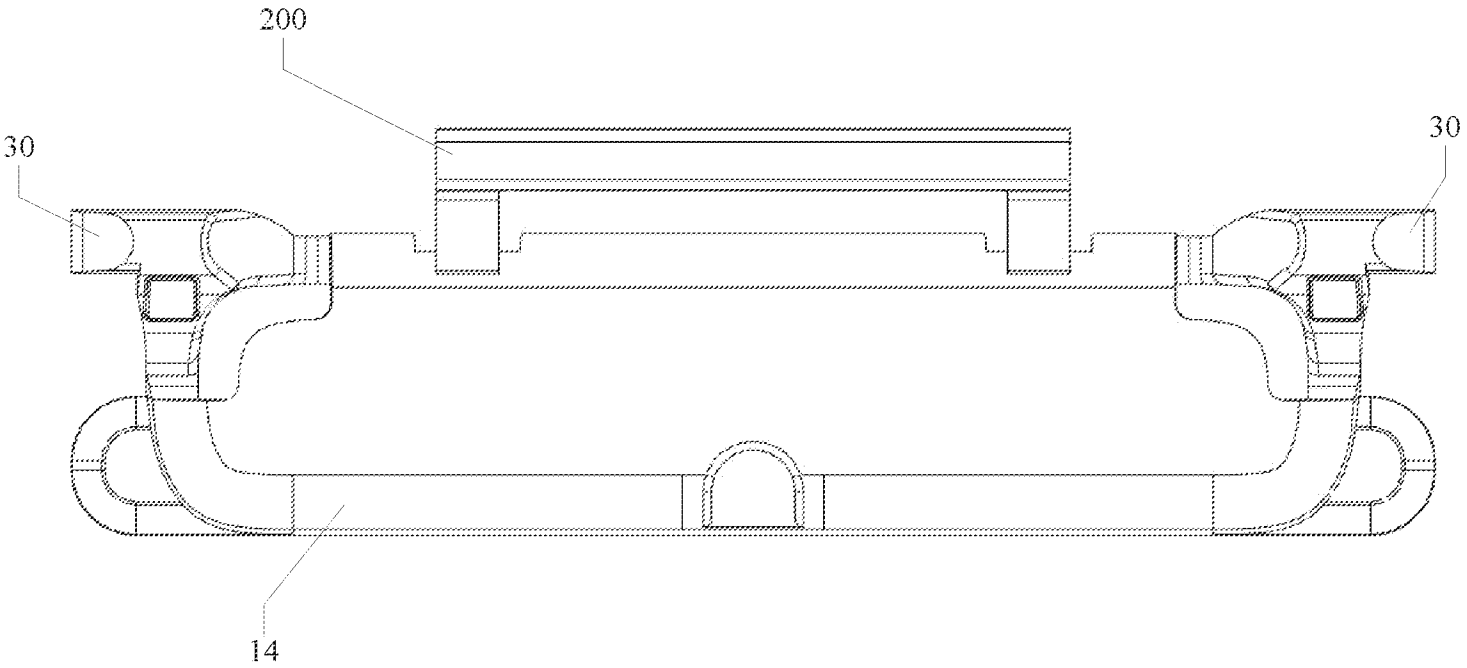
FIG. 13 is a bottom, planar view of one embodiment with the elastomeric element removed.
Figure 22:
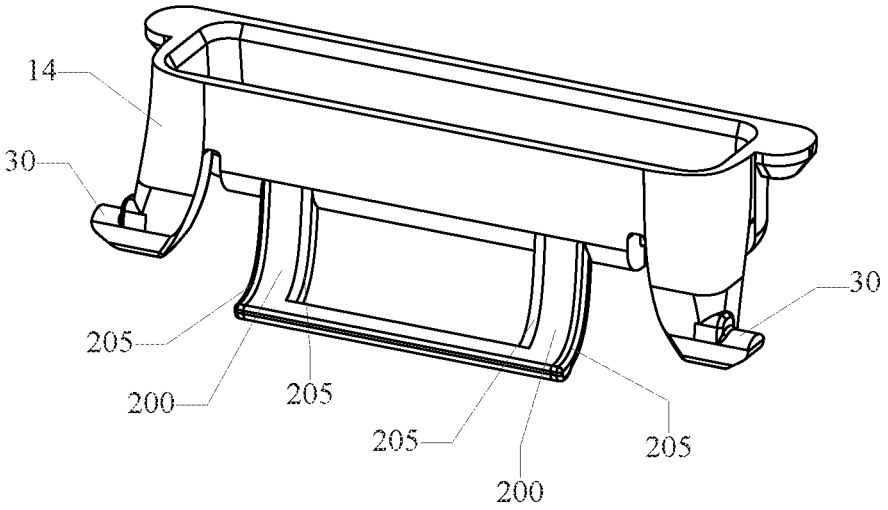
FIGS. 22-24 are perspective views of alternate embodiments showing different configurations of the elastomeric element with respect to the backbone element.
Figure 23:
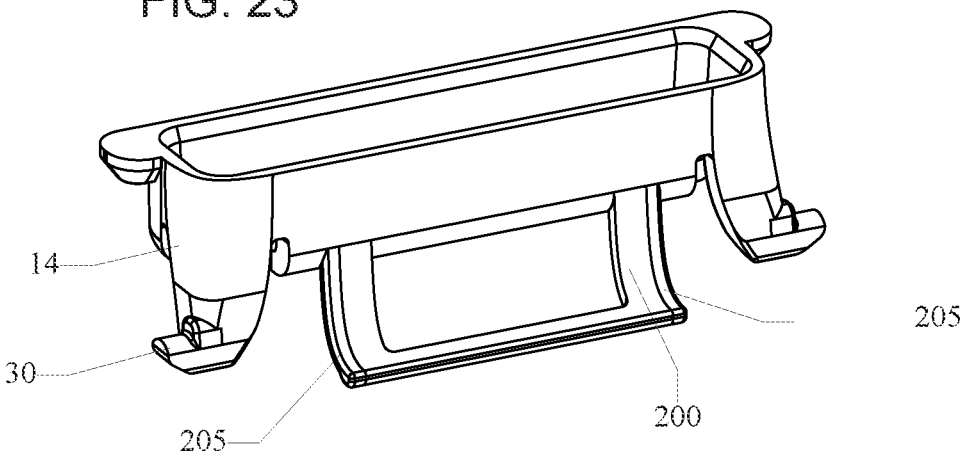
Figure 24:
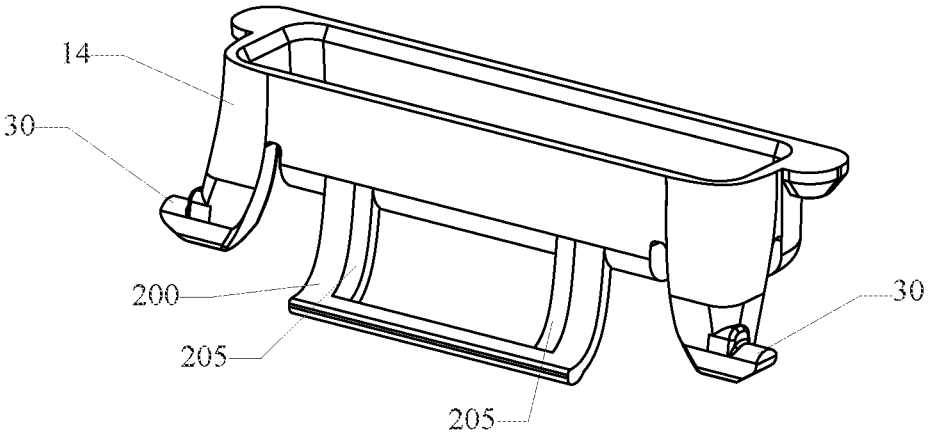

The return element may also have various shapes when seen from the side. For example, the side profile may define a single curve, as shown in FIGS. 22, 23 and 24, or a double-curved, "S" shape, as shown in FIGS. 7, 7A, and 10. The latter shape may be used to move the return force further from the pivot point of the blade unit to better balance the blade unit during shaving.

Furthermore while it was shown that the return was extending from the front surface of interface element (FIG. 7). The return element, or elements thereof, for example the elastomeric element or the backbone element, may extend from another surface of the interface element.

Accordingly, other embodiments are within the scope of the following claims.

OTHER EMBODIMENTS

A number of embodiments have been described. Nevertheless, it will be understood that various modifications may be made without departing from the spirit and scope of the disclosure.

For example, the backbone and/or elastomeric elements can be dimensioned to provide for preferred flexing areas. In some implementations, the backbone element may include a notch, groove, weakened cross-sectional region, or the like, to provide an area for preferential flexing.

Figure 20A:
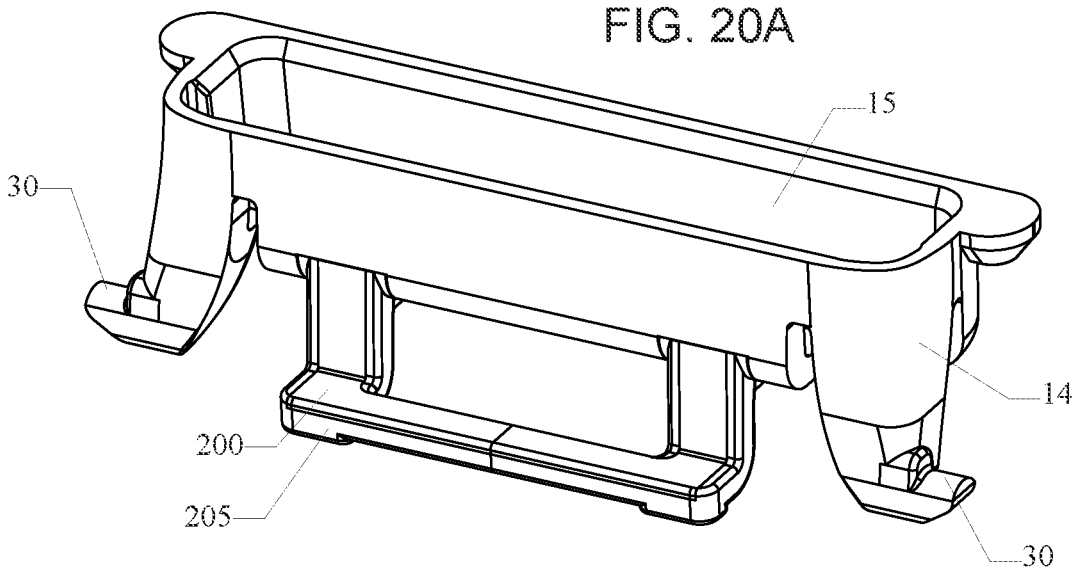
FIG. 20A is a perspective view of one embodiment.
Figure 20B:
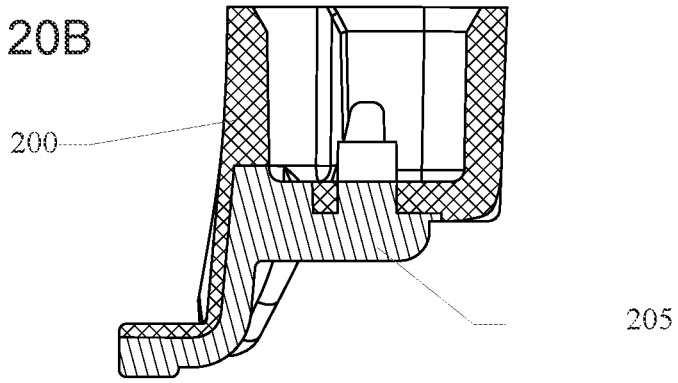
FIG. 20B is a cross-sectional view of the embodiment shown in FIG. 22A where the cross-hatched area represents an inflexible, hard-plastic material and the lined area represents an flexible, elastomeric material.
Figure 20C:
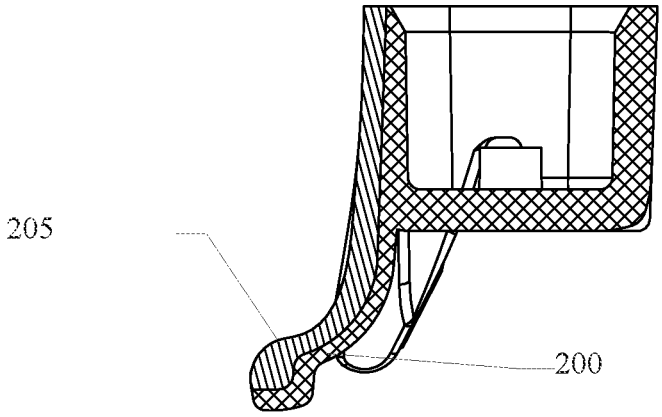
FIG. 20C is a cross-sectional view of the embodiment show in FIG. 10, where the cross-hatched area represents an inflexible, hard-plastic material and the lined area represents an flexible, elastomeric material.
Figure 21A:
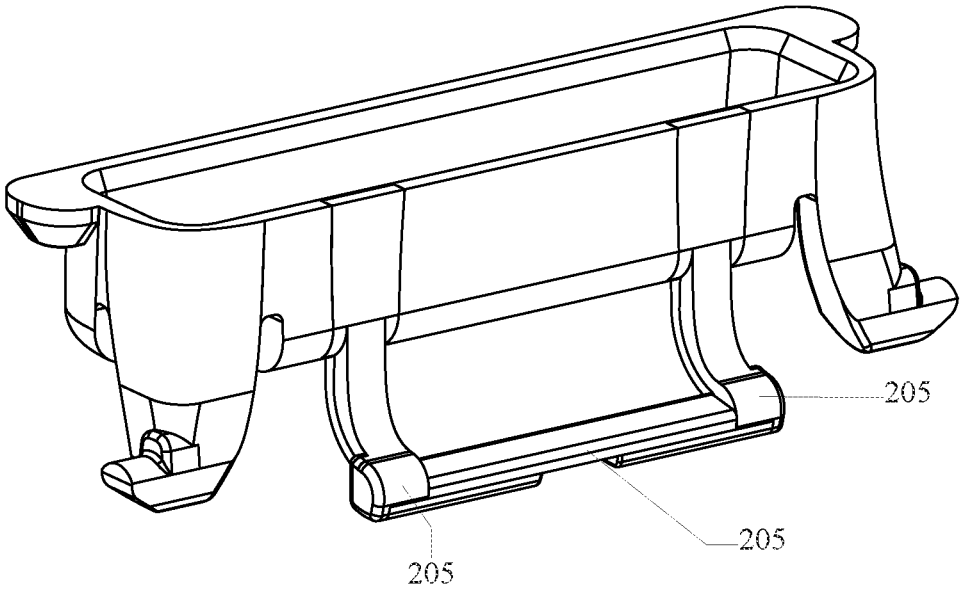
FIG. 21A is a perspective view of an embodiment showing the backbone element configured in two separate pieces connected by an elastomeric element.
Figure 21B:
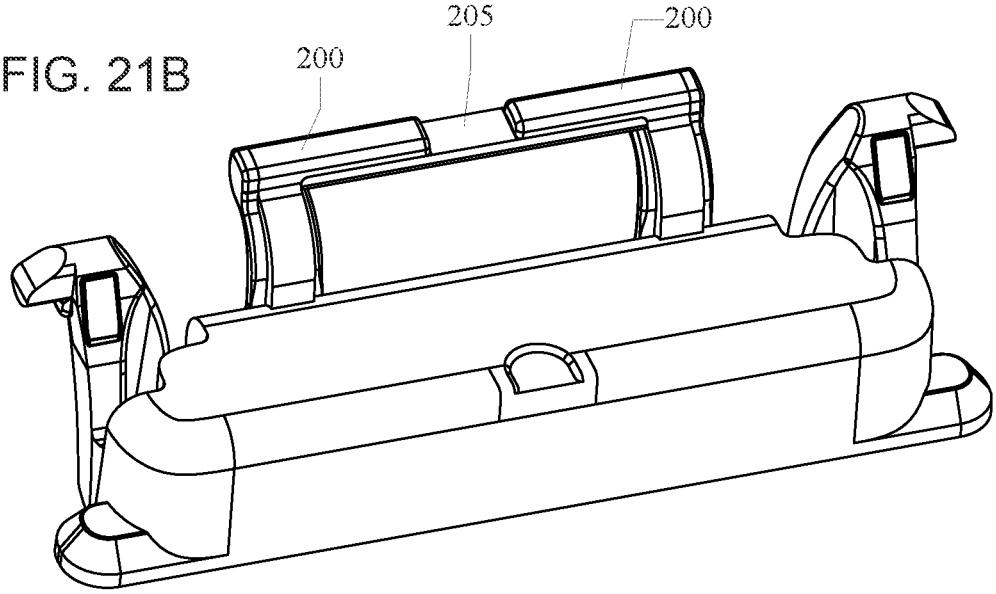
FIG. 21B is a perspective view of the embodiment shown in FIG. 23A shown from the bottom.

Also, the elastomeric element 205 may be on either the top or the underside (as shown in FIG. 20A, 20B, 20C) of the backbone element 200. Moreover, the elastomeric element 205 may be configured on the edges of the backbone element 200, or a combination of the edges and top and/or underside. For example, the elastomeric element 205 may be configured on both the inside and outside edges of the backbone element 200 (FIG. 22), or just the outside edges of the backbone element 200 (FIG. 23), or just the inside edges of the backbone element 200 (FIG. 24).

Figure 25:
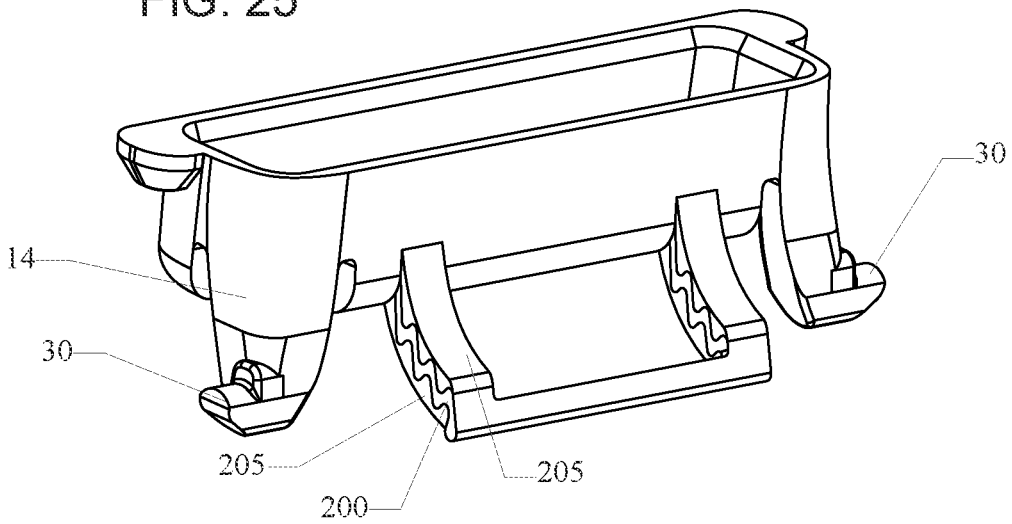
FIG. 25 is a perspective view of an alternated embodiment of the return element.

In alternative implementations, as shown in FIGS. 25A, 25B, a backbone element 200 shown in a sinusoidal shape and previously shown as a single or double curved shape, may be sandwiched between two elastomeric layers 205 or vice versa.

Figure 26:
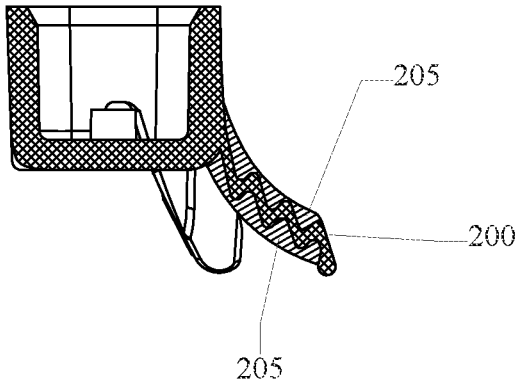
FIG. 26 is a cross-sectional view of the embodiment shown FIG. 25.
Figure 27:
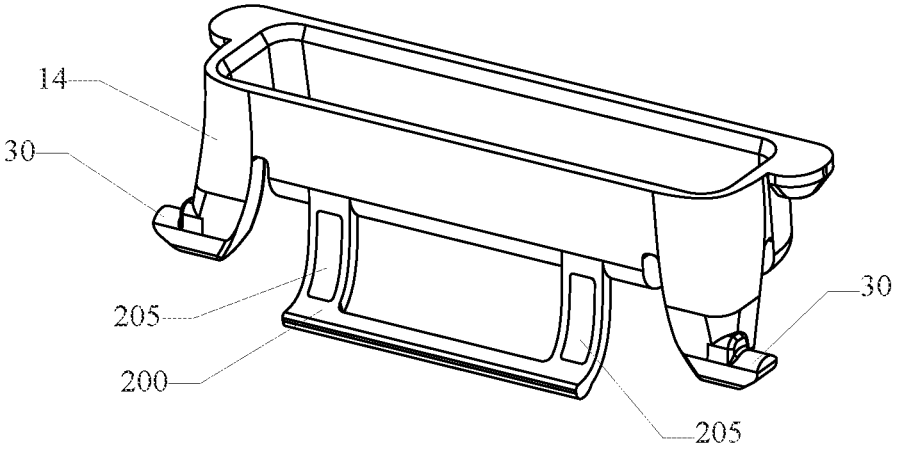
FIG. 27 is a perspective view of an alternate embodiment of the return element.

In another implementation, as shown in FIG. 26, the elastomeric element 205 may be integrally molded into the backbone element 200 so that it occupies a similar plane as the backbone element.

In addition, the backbone element can extend from a different surface of interface element.

Accordingly, other embodiments are within the scope of the following claims.

What is claimed is:

1. A replaceable shaving assembly comprising:

an interface element configured to be removeably connected to a handle, a blade unit that is pivotably mounted on the interface element, and a return element extending from the interface element, the return element including a pair of spaced first and second portions, each of the first and second portions extending from a proximal end at the interface element towards a distal end at the blade unit in a direction substantially perpendicular to a longitudinal axis of the blade unit, the distal ends of the first and second portions being joined by a third portion extending substantially parallel to the longitudinal axis, wherein the first and second portions bend during rotation of the blade unit, causing the third portion to move towards the proximal ends of the first and second portions, the return element comprising a multi-layer laminate, the multi-layer laminate including an elastomeric layer and a non-elastomeric layer.

2. The shaving assembly of claim 1, wherein the return element is configured to bias the blade unit towards a rest position with respect to a pivot axis that is generally parallel to a long axis of the blade unit.

3. The shaving assembly of claim 1, wherein the interface element comprises a substantially rigid portion defining a cavity configured to receive a distal end of the handle.

4. The shaving assembly of claim 3, wherein the return element is molded onto or attached to the substantially rigid portion of the interface element.

5. The shaving assembly of claim 1, wherein the third portion is configured to engage a surface of the blade unit.

6. The shaving assembly of claim 5, wherein the surface of the blade unit includes one or more support features configured to act as a stop for the third portion.

7. The shaving assembly of claim 1, wherein the return element is configured to bend or buckle upon rotation of the blade unit toward an upper surface of the handle.

8. The shaving assembly of claim 1, wherein the interface element comprises pivot elements that are configured to be received by corresponding elements on the blade unit.

9. The shaving assembly of claim 1, further comprising a pivot stop formed integrally with the blade unit.

10. The shaving assembly of claim 1, wherein the elastomeric layer is formed of a material having a durometer of 30 to 80 Shore A.

11. The shaving assembly of claim 1, wherein the non-elastomeric layer has a thickness of from about 0.05 to 1.5 mm.

12. The shaving assembly of claim 11, wherein the non-elastomeric layer has a ratio of width to thickness between about 1:1 and 10:1.

13. The shaving assembly of claim 11, wherein the elastomeric layer has a thickness of from about 0.25 to 2.5 mm.

14. The shaving assembly of claim 1, wherein the elastomeric layer comprises a material selected to provide a desired degree of restoring force and durability and the non-elastomeric layer comprises a material having sufficient rigidity to provide a desired degree of lateral stability to the return element.

15. A shaving system comprising:

a handle having a distal end and a proximal end; and a shaving assembly, removably mounted on the distal end of the handle, the shaving assembly having an interface element configured to be removably connected to the handle, a blade unit pivotably mounted on the interface element, and a return element extending from the interface element, the return element including a pair of spaced first and second portions, each of the first and second portions extending from a proximal end at the interface element towards a distal end at the blade unit in a direction substantially perpendicular to a longitudinal axis of the blade unit, the distal ends of the first and second portions being joined by a third portion extending substantially parallel to the longitudinal axis, wherein the first and second portions bend during rotation of the blade unit, causing the third portion to move towards the proximal ends of the first and second portions, the return element comprising a multi-layer laminate, the multi-layer laminate including an elastomeric layer and a non-elastomeric layer.

16. The shaving system of claim 15, wherein the interface element comprises a substantially rigid portion defining a cavity configured to receive a distal end of the handle.

17. The shaving system of claim 15, wherein the return element is molded onto or attached to the substantially rigid portion of the interface element.

18. The shaving system of claim 15, wherein the third portion is configured to engage a surface of the blade unit.

19. The shaving system of claim 15, wherein the return element is configured to deflect and then bend or buckle upon rotation of the blade unit toward an upper surface of the handle.

20. The shaving system of claim 15, wherein the interface element comprises pivot elements that are configured to be received by corresponding elements on the blade unit.

* * * * *